US006347424B1

(12) United States Patent
Vatne

(10) Patent No.: US 6,347,424 B1
(45) Date of Patent: Feb. 19, 2002

(54) MOVEMENT ABSORBING TRANSFERRING SYSTEM

(75) Inventor: Per Vatne, Kristiansand (NO)

(73) Assignee: Pevatek A/S, Kristiansand (NO)

( * ) Notice: Subject to any disclaimer, the term of this patent is extended or adjusted under 35 U.S.C. 154(b) by 0 days.

(21) Appl. No.: 09/465,342

(22) Filed: Dec. 16, 1999

Related U.S. Application Data

(63) Continuation of application No. PCT/NO98/00184, filed on Jun. 17, 1998.

(30) Foreign Application Priority Data

Jun. 18, 1997 (NO) ..... 972820

(51) Int. Cl.[7] ..... E01D 15/24
(52) U.S. Cl. ..... 14/69.5; 14/34; 248/181.2
(58) Field of Search ..... 14/35, 34, 71.1, 14/71.5, 69.5; 248/181.1, 181.2, 288.31, 481; 403/76, 122, 131, 132

(56) References Cited

U.S. PATENT DOCUMENTS

| | | | | | |
|---|---|---|---|---|---|
| 2,641,785 | A | * | 6/1953 | Pitts et al. | 14/71.1 |
| 4,011,615 | A | * | 3/1977 | Maxson et al. | 14/71.1 |
| 4,083,072 | A | | 4/1978 | Ryan | 14/69.5 |
| 4,133,283 | A | * | 1/1979 | Ryan | 14/71.1 |
| 4,169,296 | A | * | 10/1979 | Wipkink et al. | 14/17.1 |
| 4,363,150 | A | * | 12/1982 | Nilsson | 14/69.5 |
| 4,421,051 | A | * | 12/1983 | Hammett | 14/71.1 |
| 4,580,986 | A | * | 4/1986 | Poldervaart | 441/5 |
| 4,590,634 | A | | 5/1986 | Williams | 14/71.1 |

FOREIGN PATENT DOCUMENTS

| | | | | |
|---|---|---|---|---|
| GB | 2115361 | | 9/1983 | |
| GB | 2156743 | | 10/1985 | |
| NO | 145131 | | 1/1982 | |
| NO | 151579 | | 3/1985 | |
| NO | 157255 | | 2/1988 | |
| SE | 14158 | * | 7/1901 | 14/69.5 |

* cited by examiner

*Primary Examiner*—Thomas B. Will
*Assistant Examiner*—Raymond W. Addie
(74) *Attorney, Agent, or Firm*—Fulbright & Jaworski

(57) ABSTRACT

A motion absorbing conveyance system (1) for transferring personnel and/or objects between a floating vessel (2) and an installation (20), for example, an oil platform, where the vessel (2) and the installation (20) exhibit a relative movement, which system (1) comprises a boom (7), provided with an articulated connection to the vessel (2), a variable length gangway (6), having an articulated connection to the vessel (2), and a frame (8) joining together the ends of the boom (7, 31) and the gangway (6, 33) opposite to the articulated connection. On the installation (29) there is provided a ball seat (19). At the outer end of the gangway (6) is provided a ball (18), which is adapt to engage with the ball seat (19) on the installation (20), such that the ball/seat connection is capable of accommodating triaxial relative movement between the vessel (2) and the installation (20).

13 Claims, 49 Drawing Sheets

MOVEMENT ABSORBING TRANSFERRING SYSTEM

This application is a continuation of co-pending application Ser. No. PCT/NO98/00184, filed Jun. 17, 1998, which is claims priority to Norwegian Patent Application No. 972820, filed Jun. 18, 1997.

The present invention relates to a motion absorbing conveyance system for transferring personnel and/or objects between a floating vessel and an installation, for example, an oil platform, in accordance with the preamble of claim 1, cited hereafter. The invention also relates to a method of forming a walkable connection between a floating vessel and an installation.

There are currently employed a number of different arrangements to provide for the transfer of personnel and goods between a floating vessel and an offshore platform. Due to the relative movement between the floating vessel and the platform, strong demands are made on these types of conveyance systems. There have previously been used baskets suspended on a crane boom, where the basket is hoisted by means of a winch equipped with a heave compensator system. Hoistable baskets of this type, however, represent a high safety risk, as the relative movements between the vessel and the platform can easily cause the basket to strike against the vessel or the platform with considerable force. There is also a risk that the basket will tip over on landing, causing personnel and/or goods to fall out. Between platforms there have also been used gangways, which form a rigid connection between these platforms. These gangways, however, are not suitable for transferring personnel between a platform and a floating vessel when the relative movements are heavy.

Examples of known art are shown in NO 145,131, NO 151,579, 157,255, U.S. Pat. Nos. 3,008,158, 4,011,615 and 4,169,296. For example, U.S. Pat. No. 4,169,296 shows the use of a ball joint between the outer end of the gangway and the platform. NO 145,131, for example, shows the utilization of a pull-down wire to draw the outer end of the gangway down to the platform. None of these publications, however, suggests the possibility of using a pull-down wire in combination with a ball joint. Furthermore, all the known arrangements have the disadvantage that the gangway is self-supporting. Nor is it possible to transfer cargo of any significant weight or size along the gangway connection.

Therefore, there is a great need for a far more secure conveyance system which can form a safe, walkable connection between a floating vessel and an installation, and which at the same time is adapted to be capable of transferring cargo between two installations. Thus, according to the invention there is provided a motion absorbing conveyance system in accordance with the characterizing clause of the following claim 1. In addition, there is provided a method in accordance with the characterizing clause of the subsequent claim 6.

The invention will now be described in more detail with reference to the accompanying drawings, wherein:

FIG. 1 is a lateral view of the conveyance system in its entirety,

FIG. 2 shows a section from the conveyance system at the vessel's slewing column, which supports the gangway at one end thereof, FIG. 3 shows the outer end of the conveyance system, FIG. 4 shows the conveyance system in its unemployed position on board the vessel, FIG. 5 is a lateral view of the conveyance system in different positions at varying distances between the platform and the vessel in the vertical and horizontal direction, FIG. 6 is a top view of the conveyance system in various positions, FIG. 7 illustrates the method of connecting the conveyance system to the platform, FIG. 8 shows a means of emergency disconnection of the conveyance system, FIGS. 9–47 show an alternative embodiment of the invention, currently considered to be the most preferable embodiment, FIG. 9 illustrates the main components, FIGS. 10*a, b* and *c* show the inner part of the conveyance system, FIG. 11 shows the articulated boom, FIG. 12 shows the outer end of the boom with the frame, FIG. 13 shows the frame with a coupling device, FIG. 14 shows the coupling device, FIGS. 15*a* and *b* show a rapid release mechanism, FIGS. 16*a, b* and *c* show a footing, FIGS. 17*a* and *b* illustrate a detail of the coupling device, FIGS. 18*a, b* and *c* show a bearing housing, FIGS. 19–34 show stages in the connection of the conveyance system.

Figure 1:
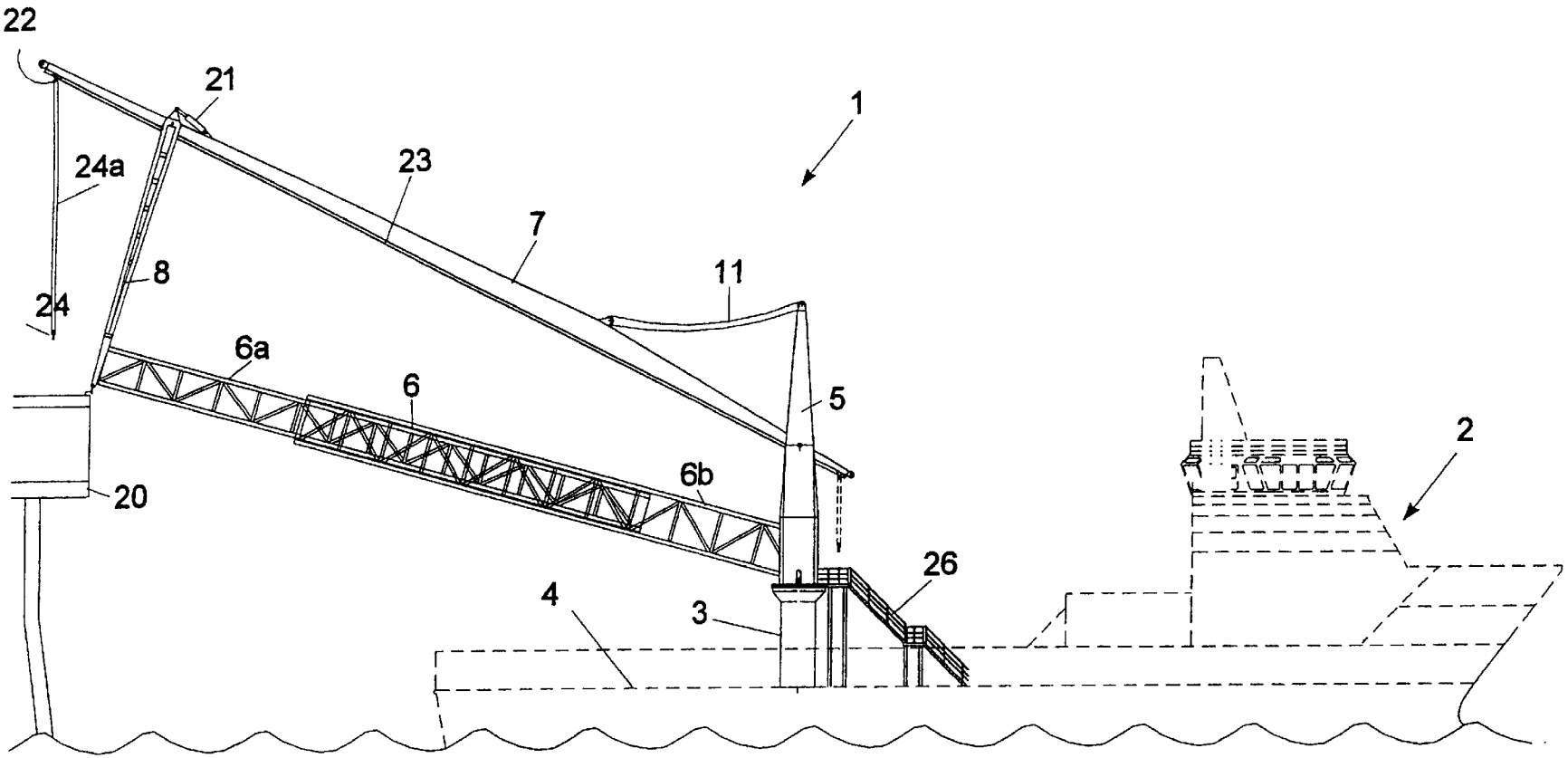

FIG. 1 shows a motion absorbing conveyance system 1 according to the invention, which is mounted on a vessel 2. The conveyance system 1 consists generally of a column 3, positioned on the deck 4 of the vessel 2, a tower 5, a gangway 6, a boom 7 and a frame 8.

Figure 2:
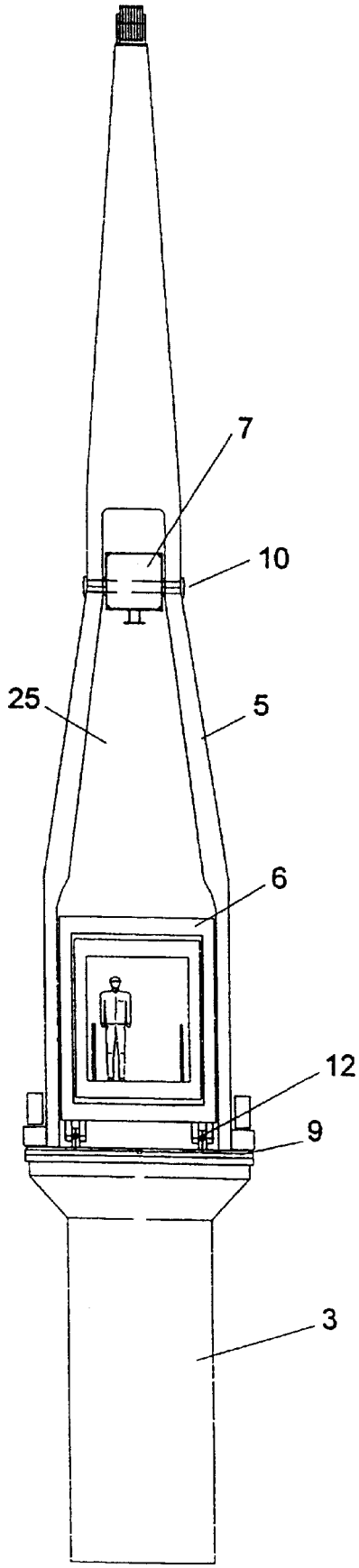

Column 3 and tower 5 are shown in more detail in FIG. 2. Tower 5 is pivotably connected to column 3, thus permitting tower 5 to rotate at least approximately 360° relative to column 3, which is permanently mounted on the deck 4 of vessel 2. To achieve this rotational capability there is provided a conventional swivel link 9 between tower 5 and column 3. Boom 7 is pivotably mounted on the tower in a joint 10. Boom 7 is thereby capable of a swinging movement in the vertical plane. A winch (not shown) is connected via a wire 11 (see FIG. 1) to boom 7, enabling the outer end of boom 7 to be hoisted up and down in the vertical plane. Gangway 6 is also pivotably connected to tower 5 by a joint 12, thereby also enabling gangway 6 to swing in the vertical plane.

Figure 3:
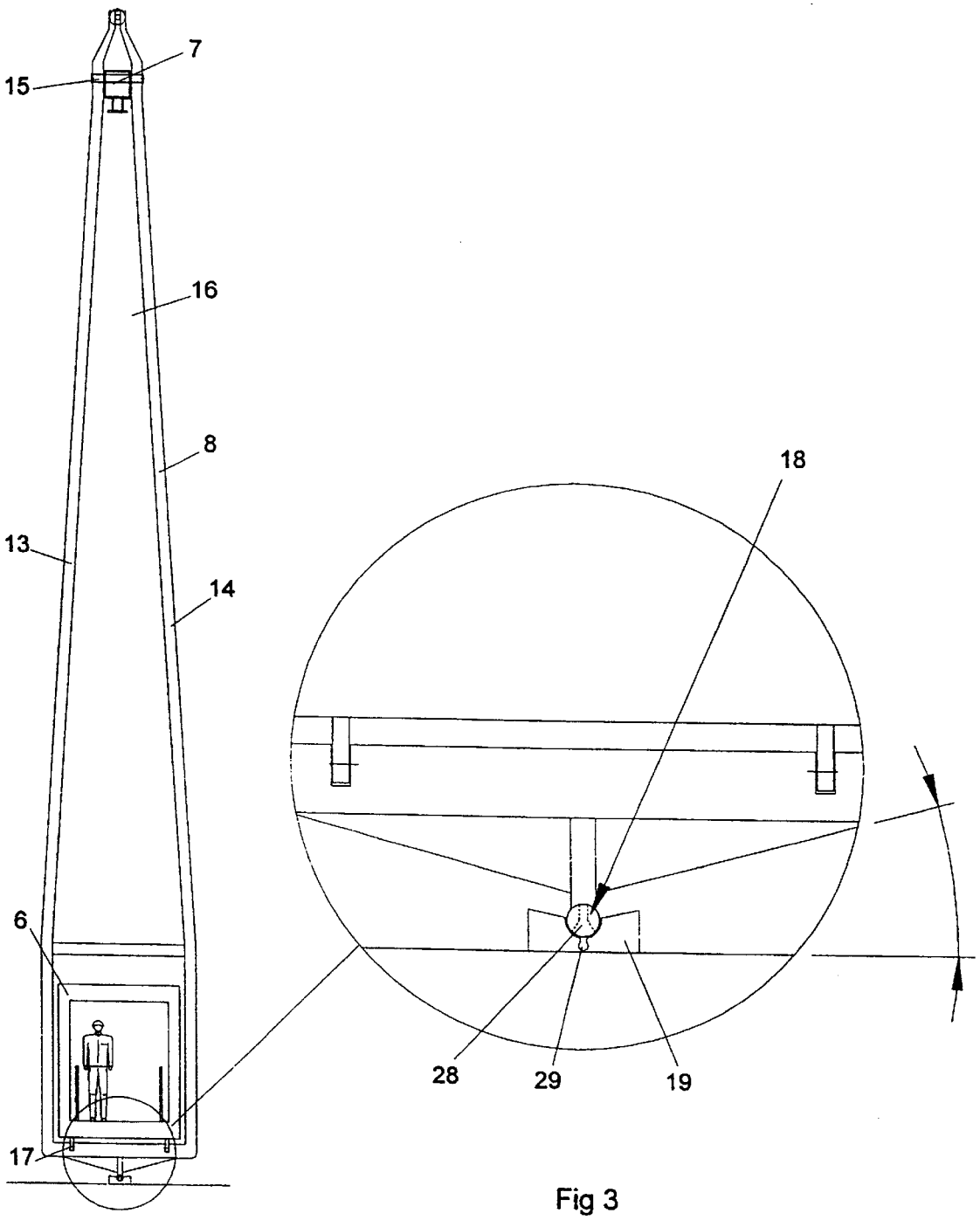

The outer end of conveyance system 1 is best illustrated in FIG. 3. Frame 8 joins together the outer ends of boom 7 and gangway 6. Frame 8 comprises a first leg 13 and a second leg 14, both of which are pivotably connected to boom 7 by a joint 15. Legs 13 and 14 define between them an open area 16. Frame 8 surrounds gangway 6 and is pivotably connected thereto by a joint 17. On the underside of frame 8 there is formed a ball. Ball 18 is designed to be received in a ball seat 19 fixedly mounted on, for example, the deck of a platform 20.

Between boom 7 and frame 8 is further provided a hydraulic actuator 21, which is designed to induce forced swinging of frame 8 in relation to boom 7. A trolley, or travelling winch, 22 is positioned in a guide rail 23 on the underside of boom 7, with capability of running along boom 7 from the outer end to the inner end thereof. Connected to trolley 22 via a wire 24*a* is a hoistable hook 24, which makes it possible to convey goods between vessel 2 and platform 20. Due to the open space 16 in frame 8, and a corresponding open space 25 in tower 5, the trolley and hook 24 are permitted to move unhindered along boom 7 above gangway 6.

Gangway 6 comprises at least two parts 6*a* and 6*b*, of which the one part 6*a* is telescopically received in the other part 6*b*. Both parts 6*a* and 6*b* are constructed of a framework, which provides protection on all sides for personnel who are on the gangway 6. Gangway 6 may either be completely enclosed, like a tunnel, or may contain openings. An access stairway 26 provides access from deck 4 to gangway 6 via the top of column 3. On the platform side, the outer end of gangway 6 is situated close enough to the platform deck that stairs on this side usually are not necessary. However, there may optionally be provided a small set of stairs on the platform deck or a descendible stairway at the outer end of gangway 6.

Figure 4:
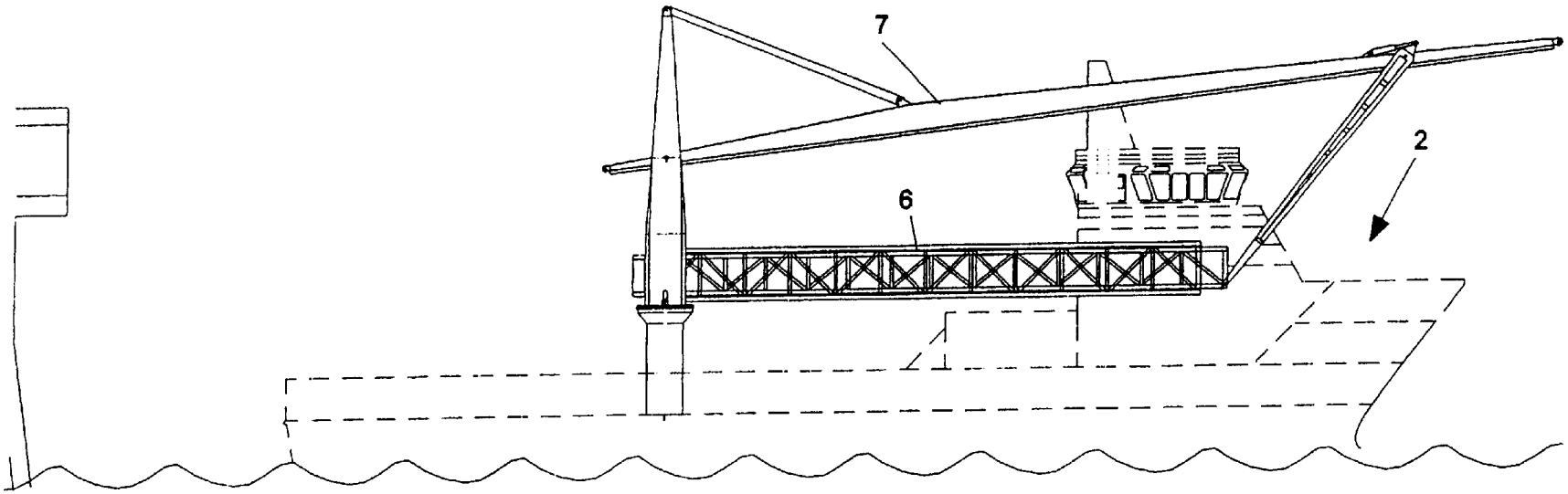
Figure 5B:
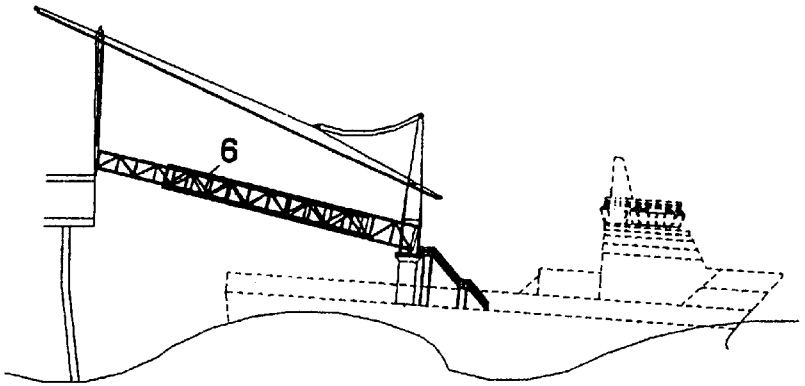
Figure 5D:
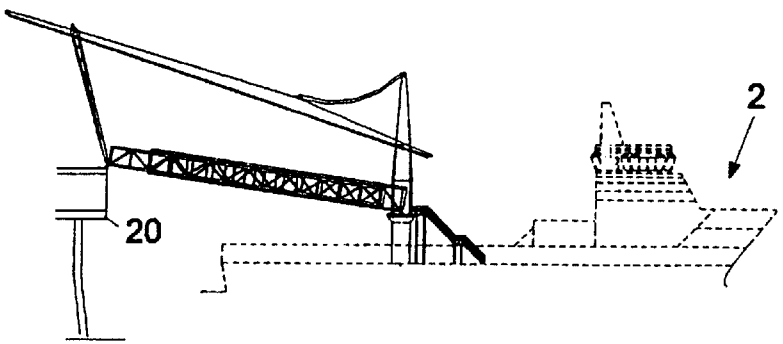
Figure 5A:
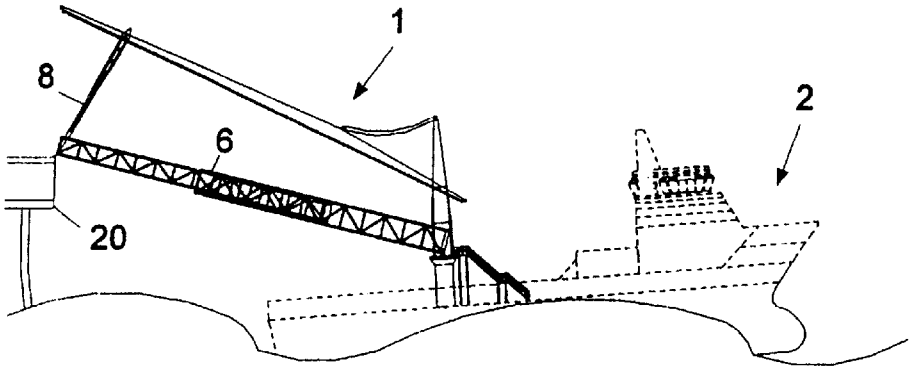
Figure 5C:
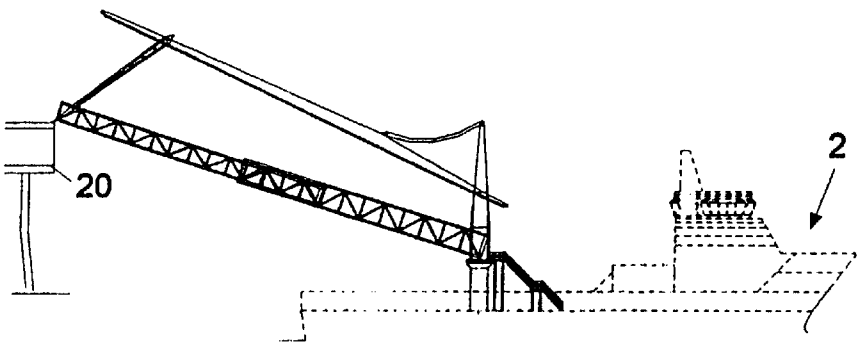

In FIG. 4 the conveyance system is shown in its unemployed state, where boom 7 and gangway 6 have been swung to a rest position above vessel 2. In an unemployed state, gangway 6 may optionally be released from lower 5 and frame 8 and removed, and frame 8 may either be swung inward against boom 7 or also removed, permitting column 3, tower 5 and boom 7 to be used as a conventional crane.

FIG. 5 shows the conveyance system in various states depending on the particular positioning of vessel 2 in relation to platform 20. Due to the ball joint, gangway 6 and frame 8 will be capable of pivoting in three directions relative to platform 20 around the ball joint 18, 19. In FIG. 5*a* the inner end of the gangway is situated 1 meter lower than nominal position and 6.5 meters further away from the platform than nominal position. The movement toward and away from the platform is primarily accommodated by the telescopic action of gangway 6. In FIG. 5*b* the inner end of gangway 6 is situated 2.5 meters higher than nominal position and 5.5 meters closer to the platform than nominal position. FIGS. 5*c* and 5*d* illustrate the two extreme positions for the conveyance system, with FIG. 5*c* showing vessel 1 at its lowest position and greatest distance away from platform 20, and FIG. 5*d* showing vessel 2 at its highest position and shortest distance to platform 20. Here the distance from the vessel to the platform may vary by about 20 meters without imposing undue strain on the conveyance system. The wave height from top to bottom may be as much as 13 meters without straining the conveyance system.

Figure 6B:
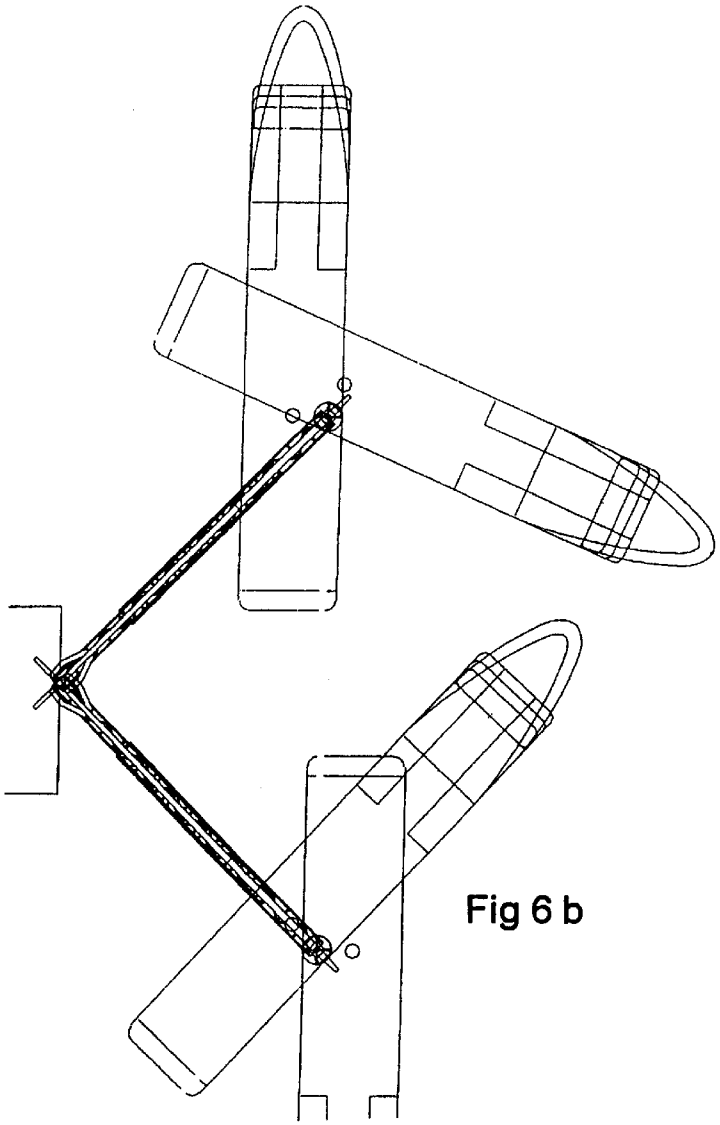
Figure 6A:
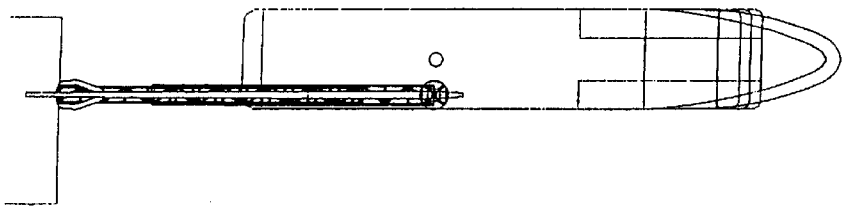

FIG. 6 shows the conveyance system viewed from above; in FIG. 6*a* it is in nominal position and FIG. 6*b* shows four different extreme positions. As is apparent from FIG. 6*b*, the conveyance system is capable of pivoting over a 90° sector without being overextended. The vessel may also alter its position in relation to the platform by 180°.

In FIG. 3 the maximum rolling movement of conveyance system 1 is indicated by angle V.

Figure 7A:
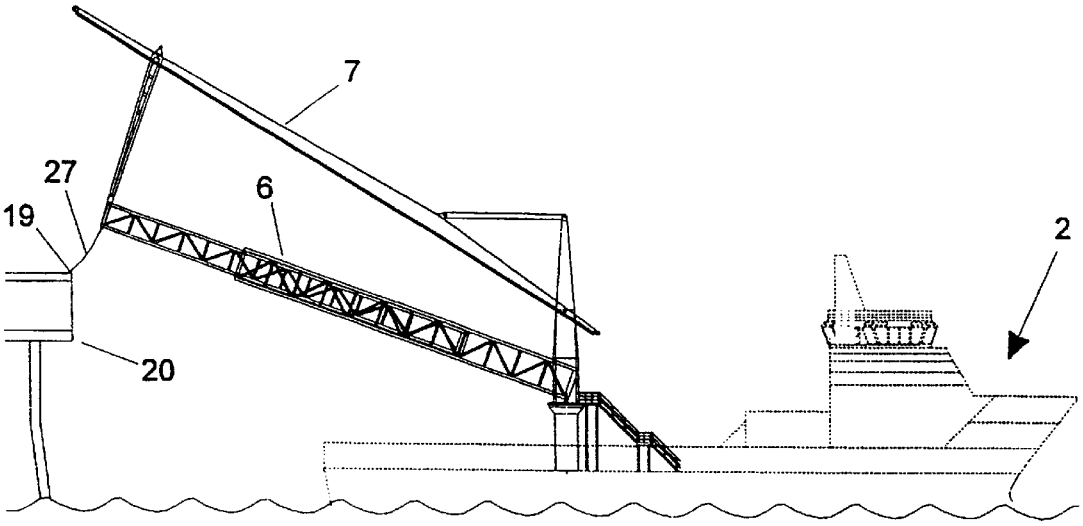
Figure 7B:
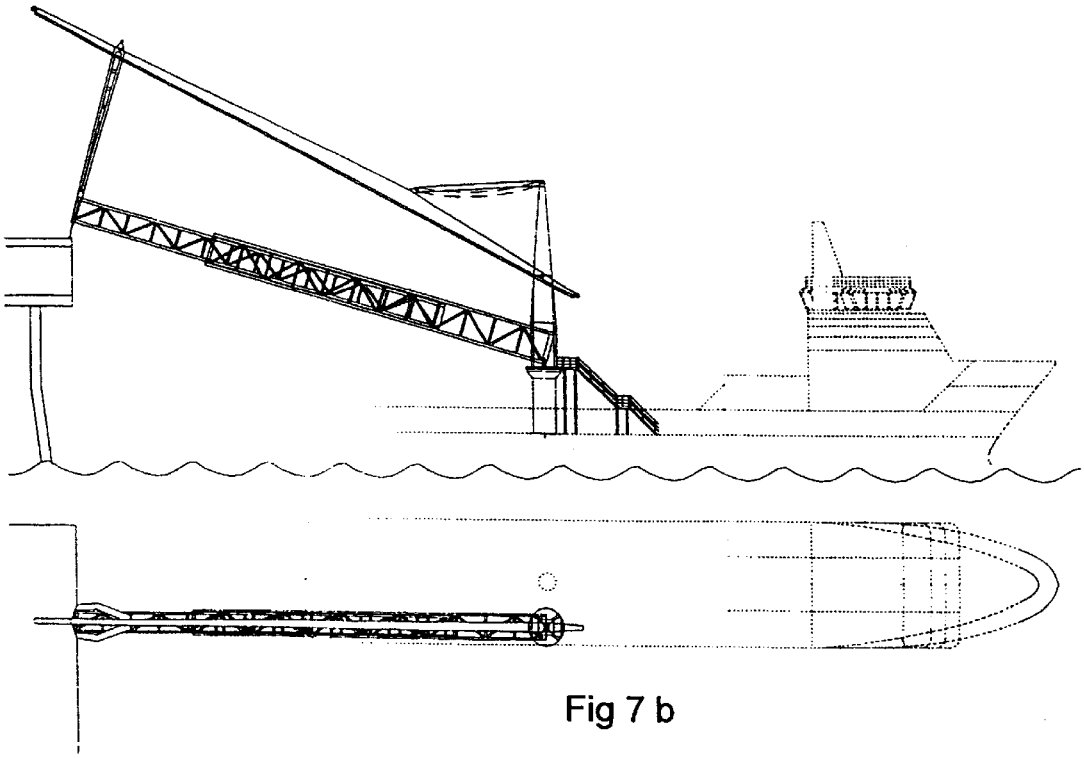

The method of providing a walkable connection between vessel 2 and platform 20 will now be explained with reference to FIG. 7. In FIG. 7*a* the outer end of gangway 6 is brought to a position generally over the ball seat 19 on platform 20. In order to position the ball over the ball seat, tower 5 is rotated and frame 8 is swung with the aid of actuator 21 until the ball is in the correct position. A wire 27, which passes through a hole 28 in ball 19 is lowered down toward platform 20. Wire 27 may be secured in a receiving device 29 in ball seat 19, either by remote control or manually with the aid of personnel on platform 20. While the winch that holds boom 7 is put into operation under constant pressure, and the slewing motor and the brake controlling the rotation of tower 5 and actuator 21 for frame 8 are disengaged, a winch is engaged to exert a tension on wire 27, in order thereby to draw ball 18 down toward ball seat 19. As soon as contact is made between ball 18 and ball seat 19, the winch supporting boom 7 is slackened, allowing ball 18 to come to rest in ball seat 19 and to be pressed thereagainst by the weight of boom 7, frame 8 and gangway 6.

The procedure for disengagement will be the opposite of the above, as the winch for boom 7 is put into operation, and the winch for wire 27 is slackened until ball 18 has lifted from ball seat 19 to a sufficient degree for wire 27 to be released from ball seat 19. Boom 7 and gangway 6 can then be swung in over vessel 2.

Figure 8:
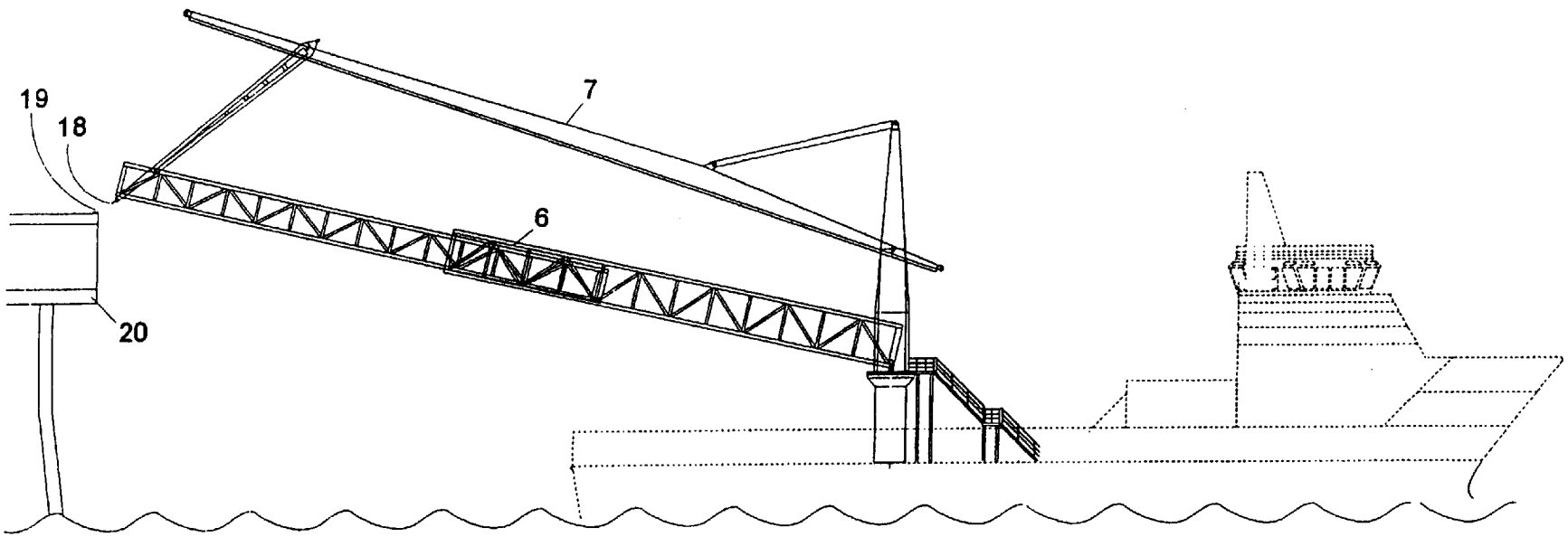

An emergency procedure for disengaging the connection is shown in FIG. 8. In this type of situation the winch for boom 7 is actuated at the same time as the vessel is driven in a direction away from platform 20. The telescopic connection between gangway sections 6*a* and 6*b* enables gangway 6 to be extended until it has reached its end position and, due to the combined effect of the boom 7 lifting the outer end of gangway 6 and the outwardly directed force of gangway 6, ball 18 is released from ball seat 19. The connection between wire 27 and ball seat 19 is disengaged when the emergency procedure is started.

In the following is a description of a system with an articulated boom, with reference to FIGS. 9 to 47. An articulated boom substantially reduces the torque imposed on the column during engagement and disengagement. In addition, it is a space saving feature when the boom is stowed on the deck during transit.

Figure 9:
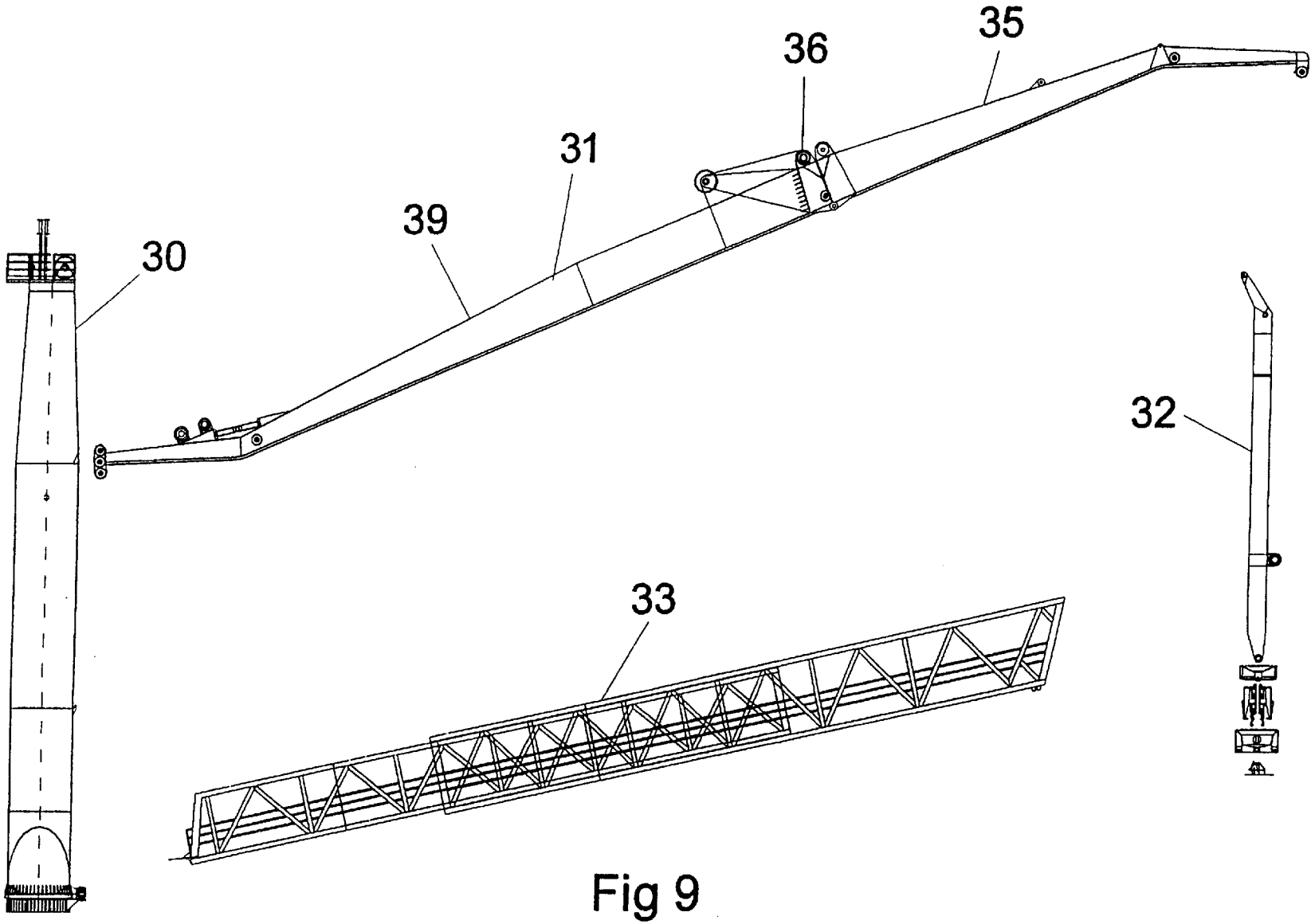

FIG. 9 shows the system's main components, including a column 30, a boom 31, a frame 32 and a gangway 33. The boom is a two-part structure, with an inner section 34 and outer section 35, which are connected together at joint B via a hinge mechanism 36.

Figure 10A:
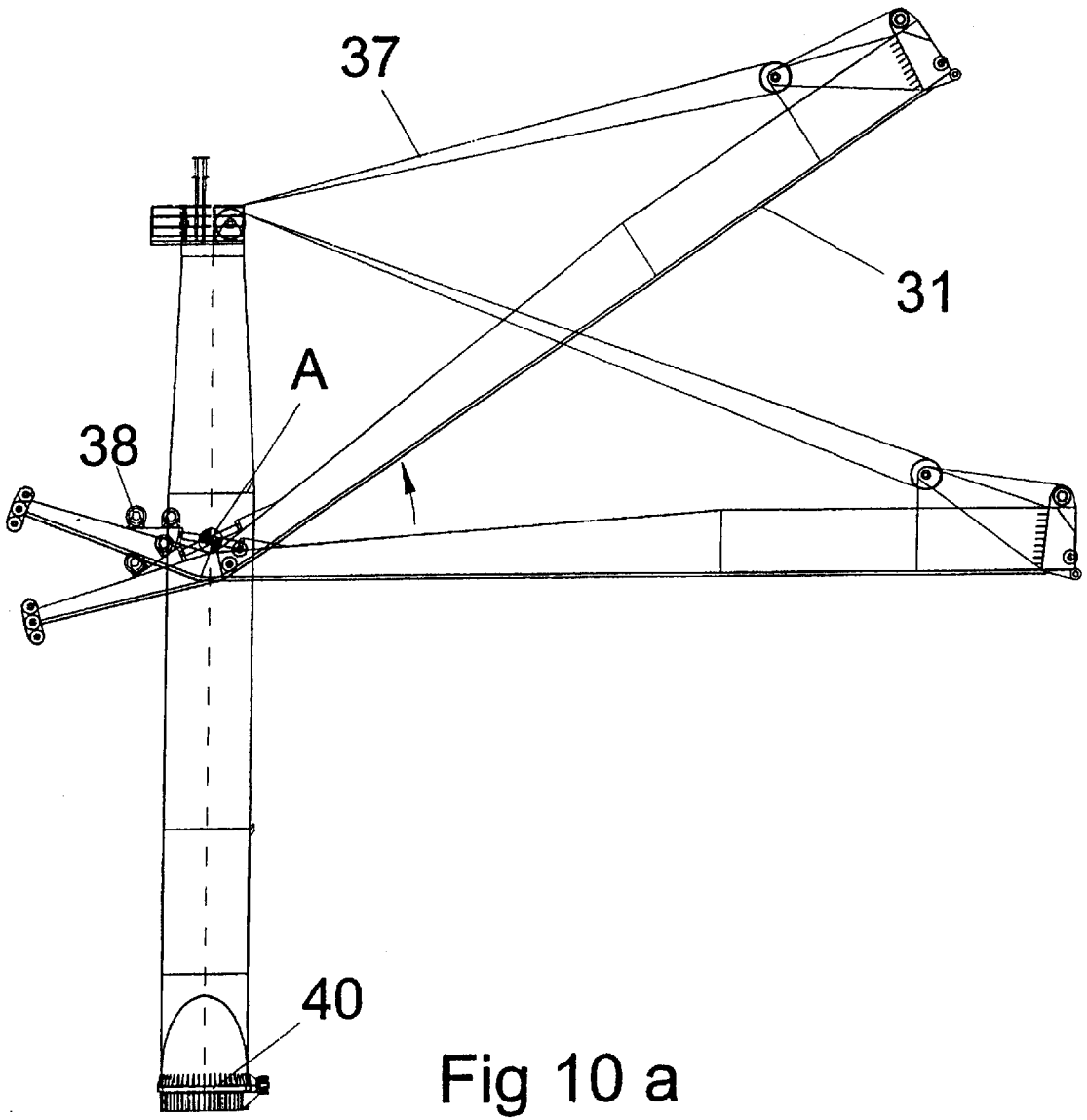
Figure 10B:
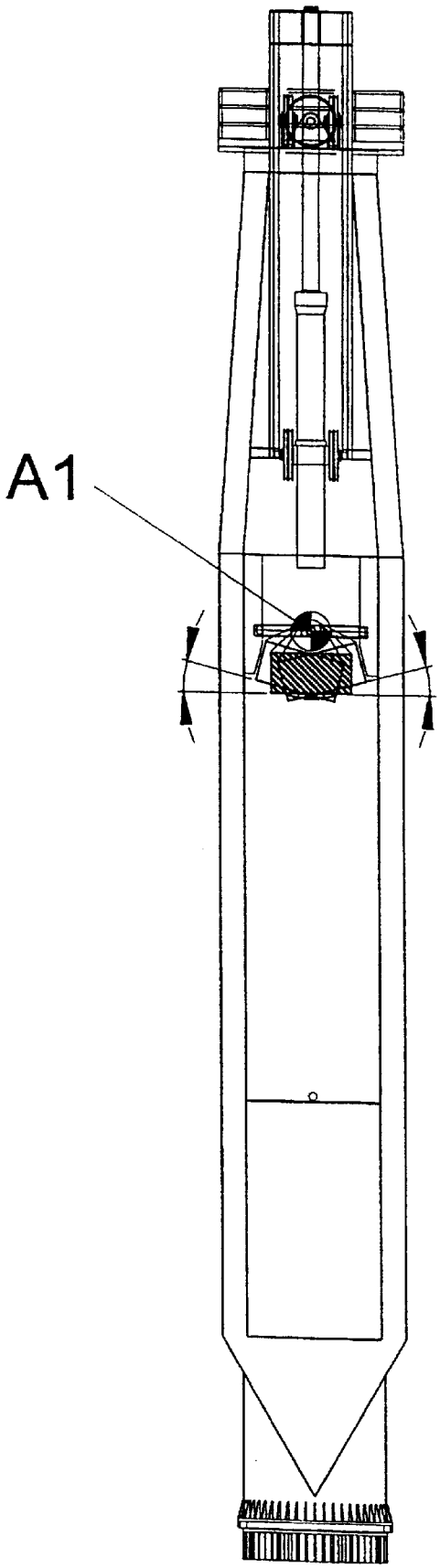
Figure 10C:
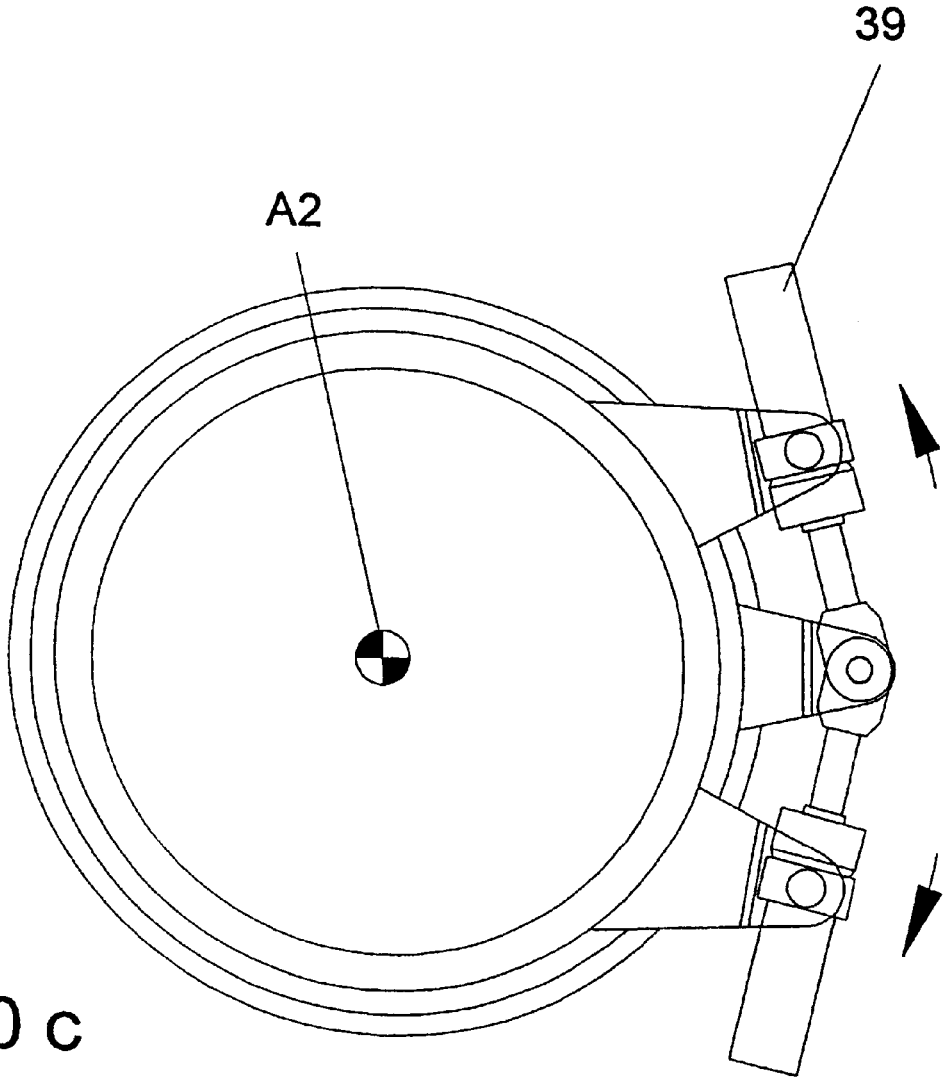

FIGS. 10*a*–10*c* show column 30 with suspension and hoisting means 37 for boom 31. The boom is articulated, as mentioned above, and only the innermost section 34 is shown here. Boom 31 is lifted by a wire hoisting system 37 from the top of column 30. Boom 31 is suspended in a biaxial bearing system 38 in column 30. Boom 31 pivots about the transverse horizontal axis A (FIG. 10*a*) on lifting and lowering and is capable of free rotation about the longitudinal axis A1 (FIG. 10*b*).

Column 30 is mounted on the ship deck on a bearing and is capable of rotation about the vertical axis A2 (FIG. 10*c*). Slewing actuators 39 are mounted in connection with bearing 40; these may be disengaged, or they may control the pivotal motion of column 30.

Figure 11:
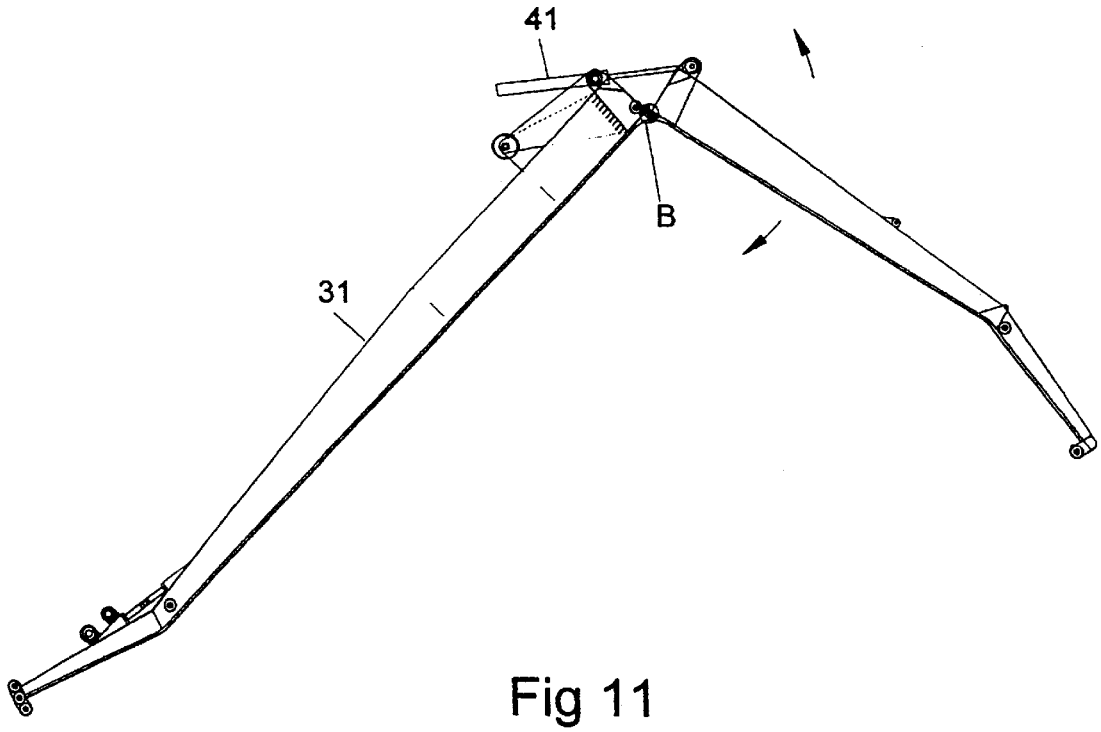

FIG. 11 shows boom 31 with hinge mechanism 36 at joint B. A hydraulic cylinder 41 mounted at the top of boom 31 controls the folding thereof and limits the movement on maximum swing. On contraction of cylinder 41, boom 31 is straightened and the movement is mechanically restricted such that the lower edge of the two boom sections 34, 35 form a straight line.

Figure 12:
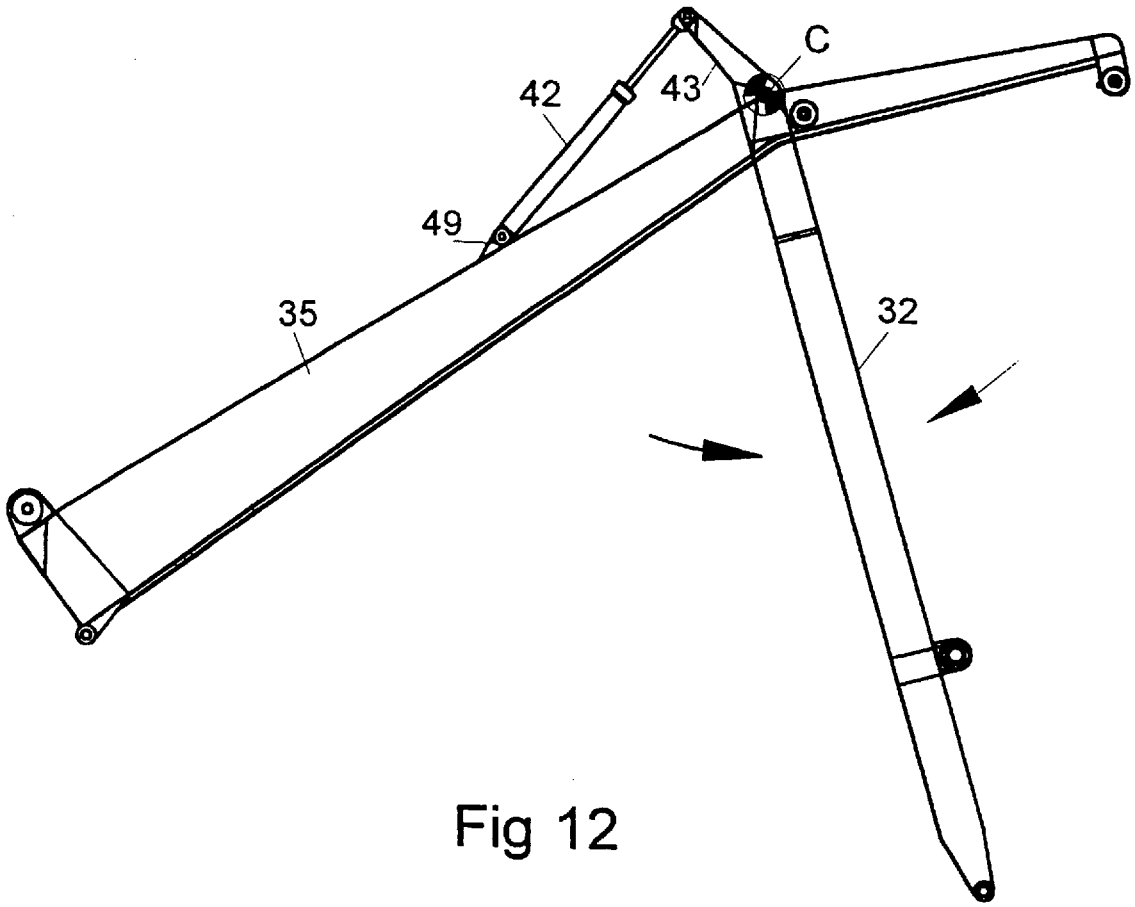

FIG. 12 shows the connection between outer section 35 of boom 31 and frame 32. Frame 32 is hinged to boom section 35 at axis C. The rotation of frame 32 is controlled by means of a hydraulic cylinder 42 mounted between the top 43 of frame 32 and a bracket 44 on boom 31.

Figure 13:
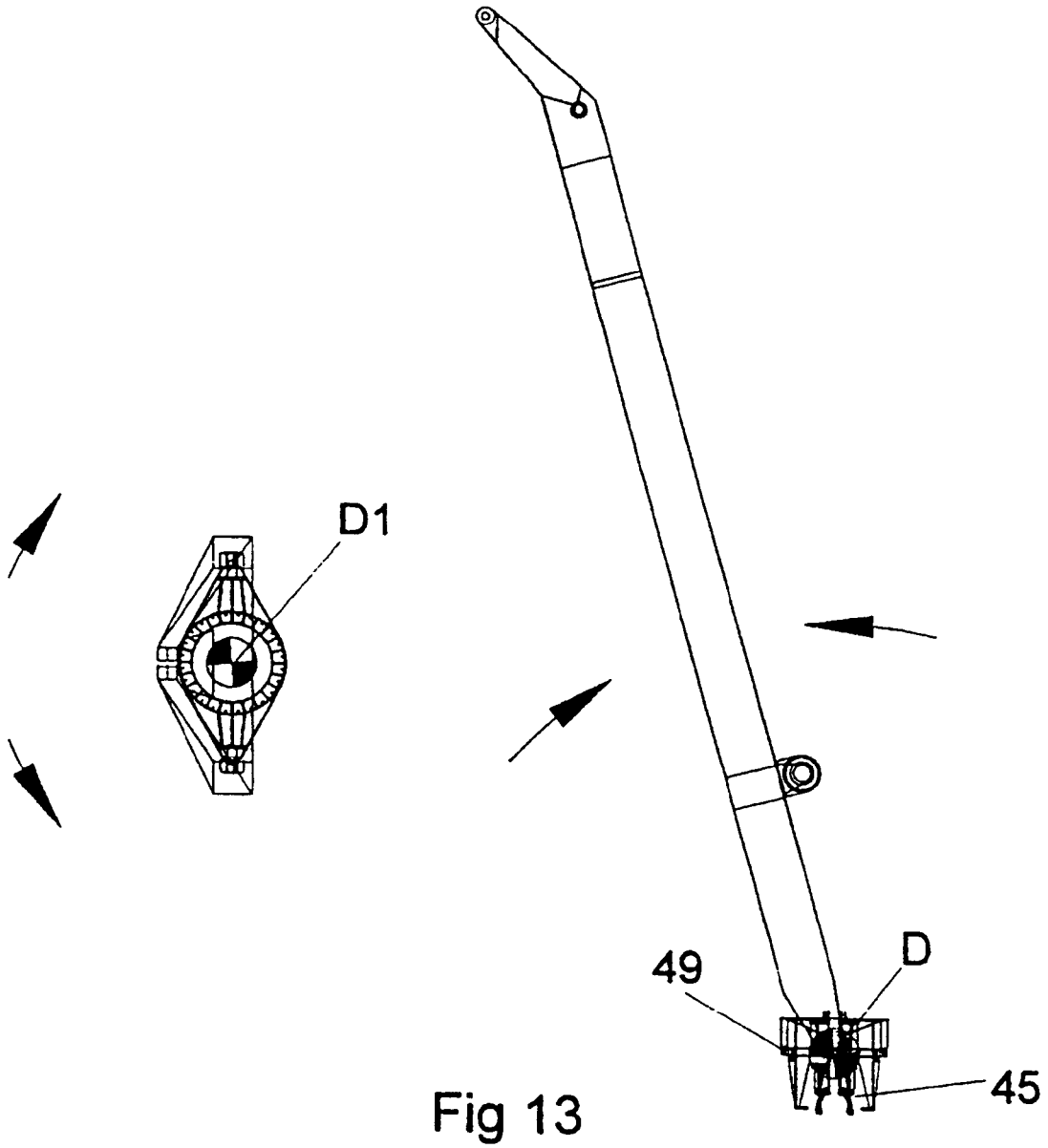
Figure 14:
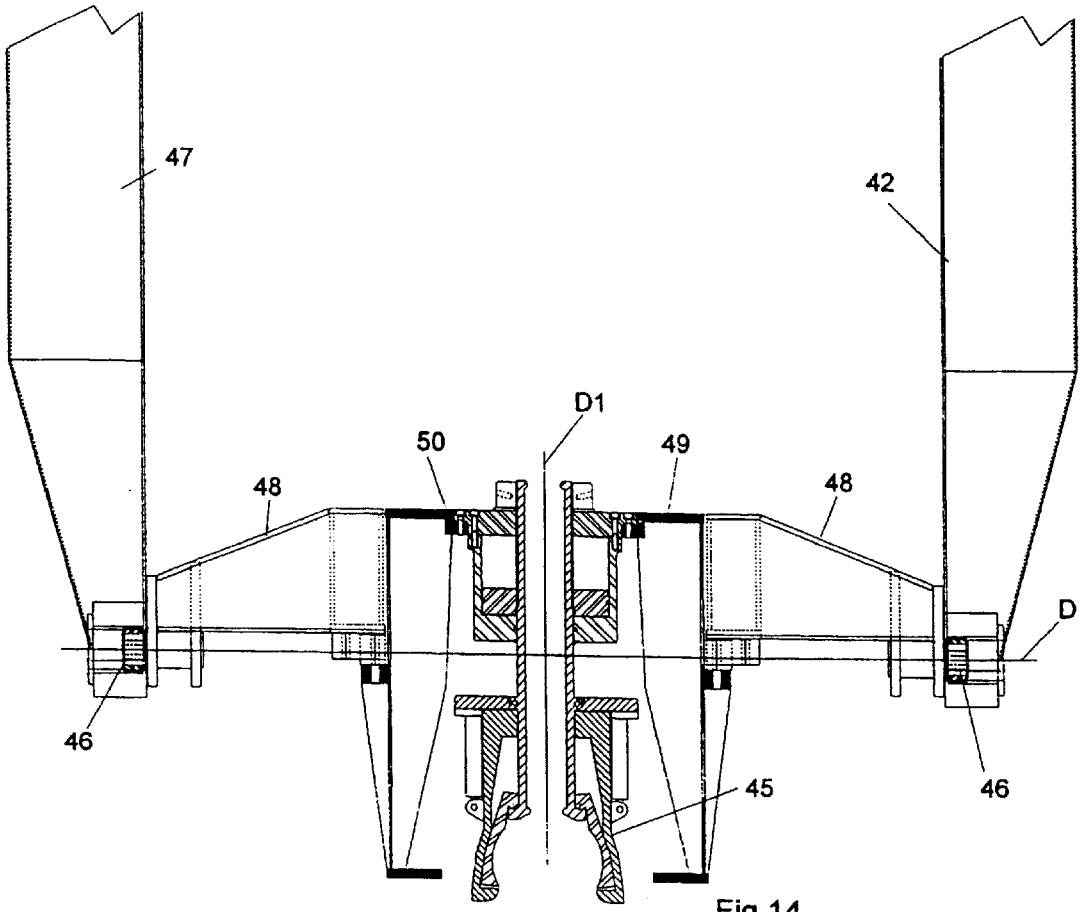

FIGS. 13 and 14 show frame 32 with bearing 49 and coupling member 45. Frame 32 and coupling member 45 are able to swing freely relative to each other about horizontal axis D, which as shown in FIG. 14 extends through two journal bearings 46, mounted on two arms 48 on bearing housing 49, which journal bearings 46 receive the legs 47 of frame 32. A pivot bearing 50 mounted between bearing housing 49 and coupling member 45 defines the vertical axis D1 around which frame 32 with bearing housing 49 can rotate.

Below there will now be explained, with reference to FIGS. 15*a* and 15*b*, 16*a–c*, 17*a* and 17*b* and 18*a–c*, the elements in the landing system for the platform connection, which consists of the following main components: rapid release mechanism 51 (see FIGS. 15*a–b*), footing 52 with locking ball 53 (see FIGS. 16*a–c*), coupling member 45 with pull-down cylinder 54 (see FIGS. 17*a–b*) and bearing housing 49 for frame 32 (see FIGS. 18*a–c*).

Figure 15A:
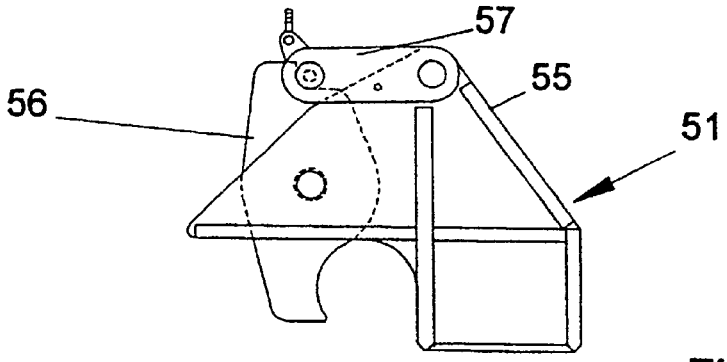
Figure 15B:
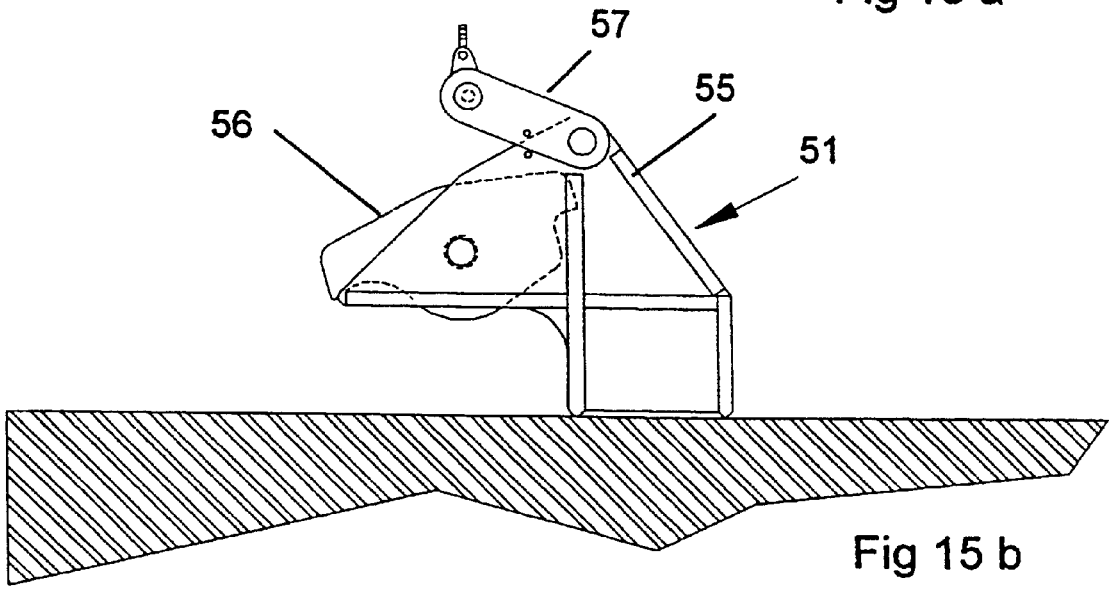
Figure 16B:
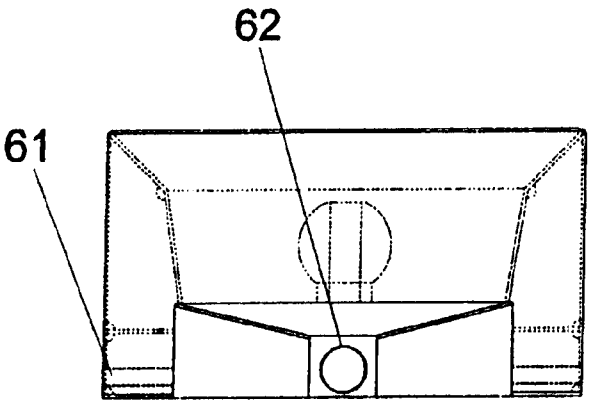
Figure 16A:
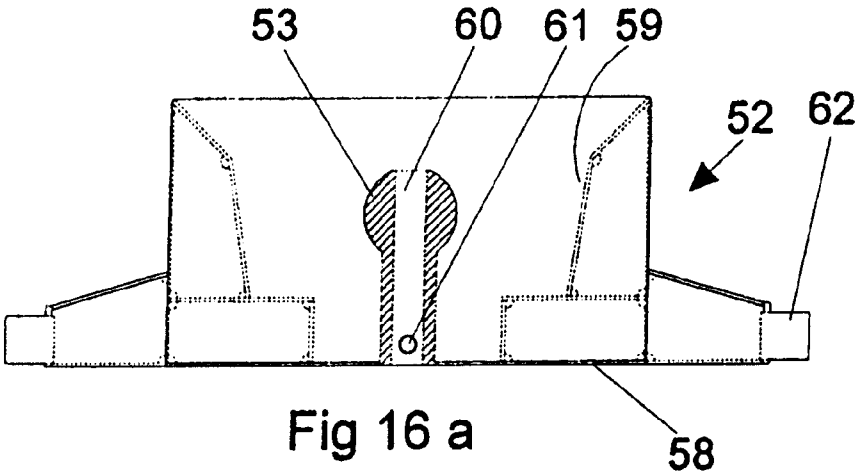
Figure 16C:
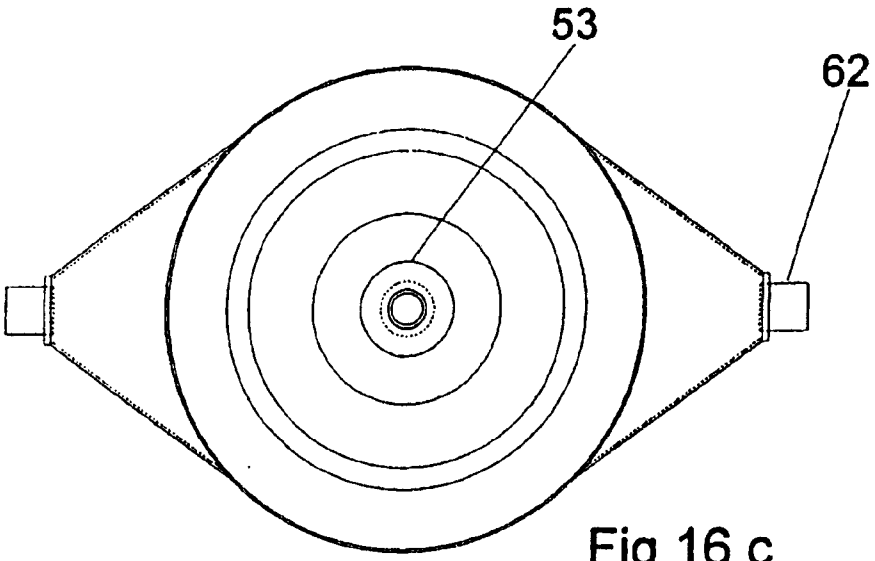

The rapid release mechanism in FIGS. 15*a–b* consists of a housing 55, a locking pawl 56 and a tripping device 57. Tripping device 57 is connected with the ship and is controlled therefrom via mechanical or electrical remote control. On the platform there are provided two such rapid release mechanisms 51, which are welded fast to the platform on each side of a footing 52 having a locking ball 53 (see FIGS. 16*a, b* and *c*).

Footing 52 consists of a circular housing 58 with an internal conical guide surface 59, locking ball 53 with an internal vertical bore 60 for a pull-in wire, a horizontal bore 61 for locking of the pull-in wire and anchor pins 62. Locking pawls 56 lock the pins 62 so that footing 52 is secured to the platform deck.

Figure 17B:
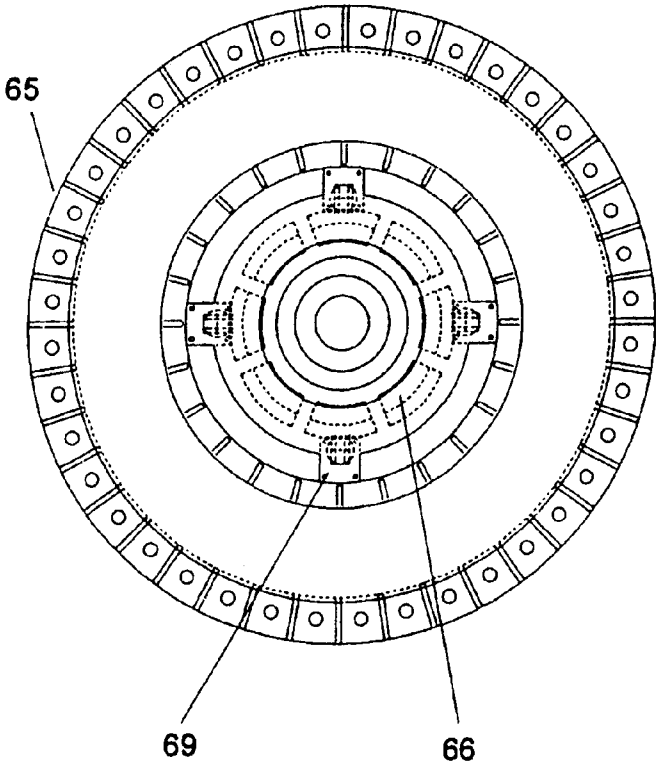
Figure 17A:
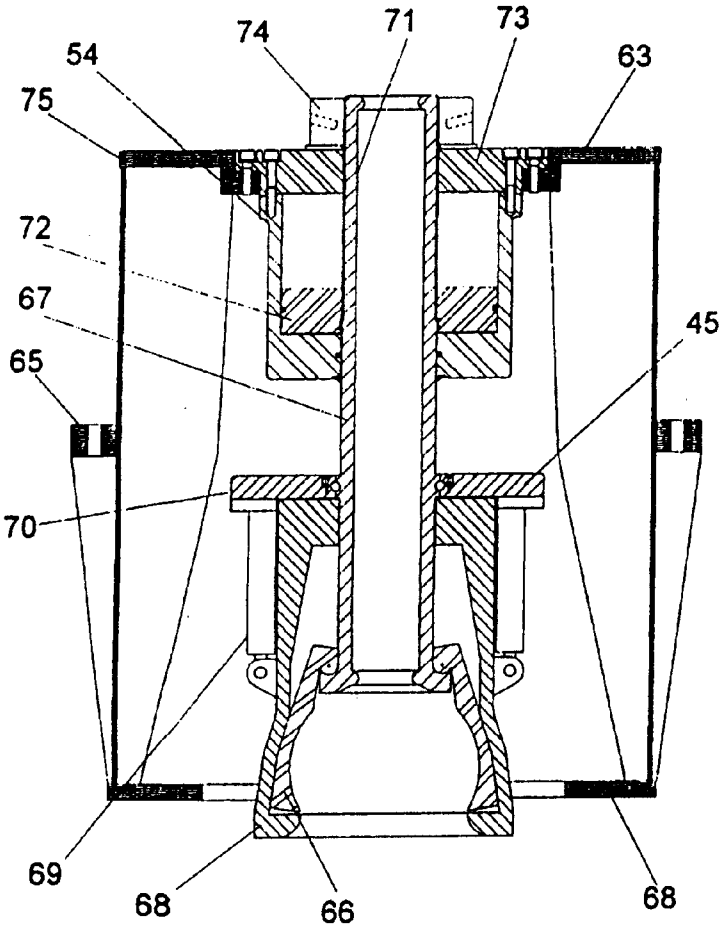

FIG. 17*a* shows a vertical section through coupling member 45 with pull-down cylinder 54, while FIG. 17*b* shows a bottom view of the same. In FIG. 17*a* is seen a circular terminal cap 75 having a top flange 63 for insertion of a pull-down cylinder 54 and a landing flange 64 at the bottom, together with an external flange 65 for a pivot bearing. Eight locking dogs 66 are suspended at the lower end of a cylinder rod 67.

Locking dogs 66 are spherical in shape internally and circular-conical externally. A skirt 68 having a corresponding circular-conical form internally, is vertically movable with the aid of actuators 69 attached to a flange 70 which, in turn is attached to cylinder rod 67. On lowering of skirt 68 the locking dogs 66 are forced together and thereby are lockable around ball 53 (see FIG. 16*a*). Cylinder rod 67 is provided with a through longitudinal bore 71 for pulling through wires and is mounted in a piston 72 which is vertically movable in cylinder 54. Rod 67 passes through top flange 73 of cylinder 54 and has an external nut 74 screwed thereon.

Figure 18B:
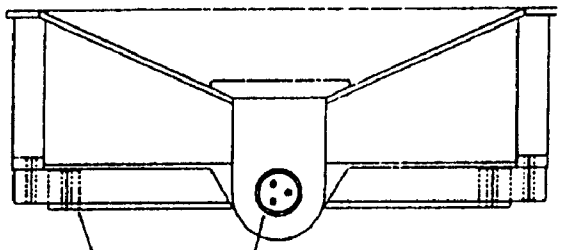
Figure 18A:
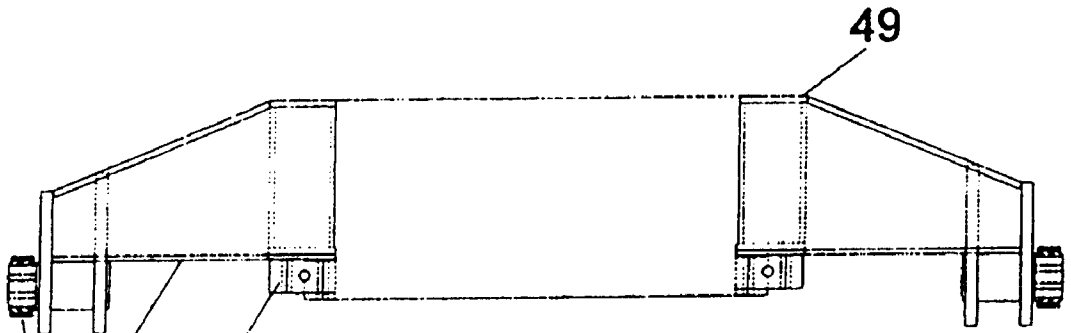
Figure 18C:
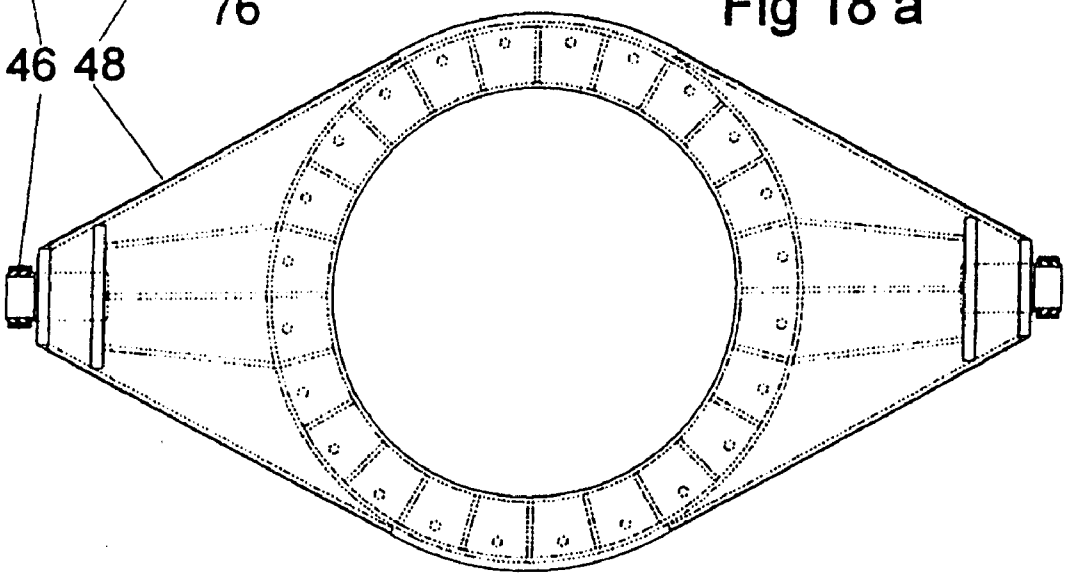
Figure 19:
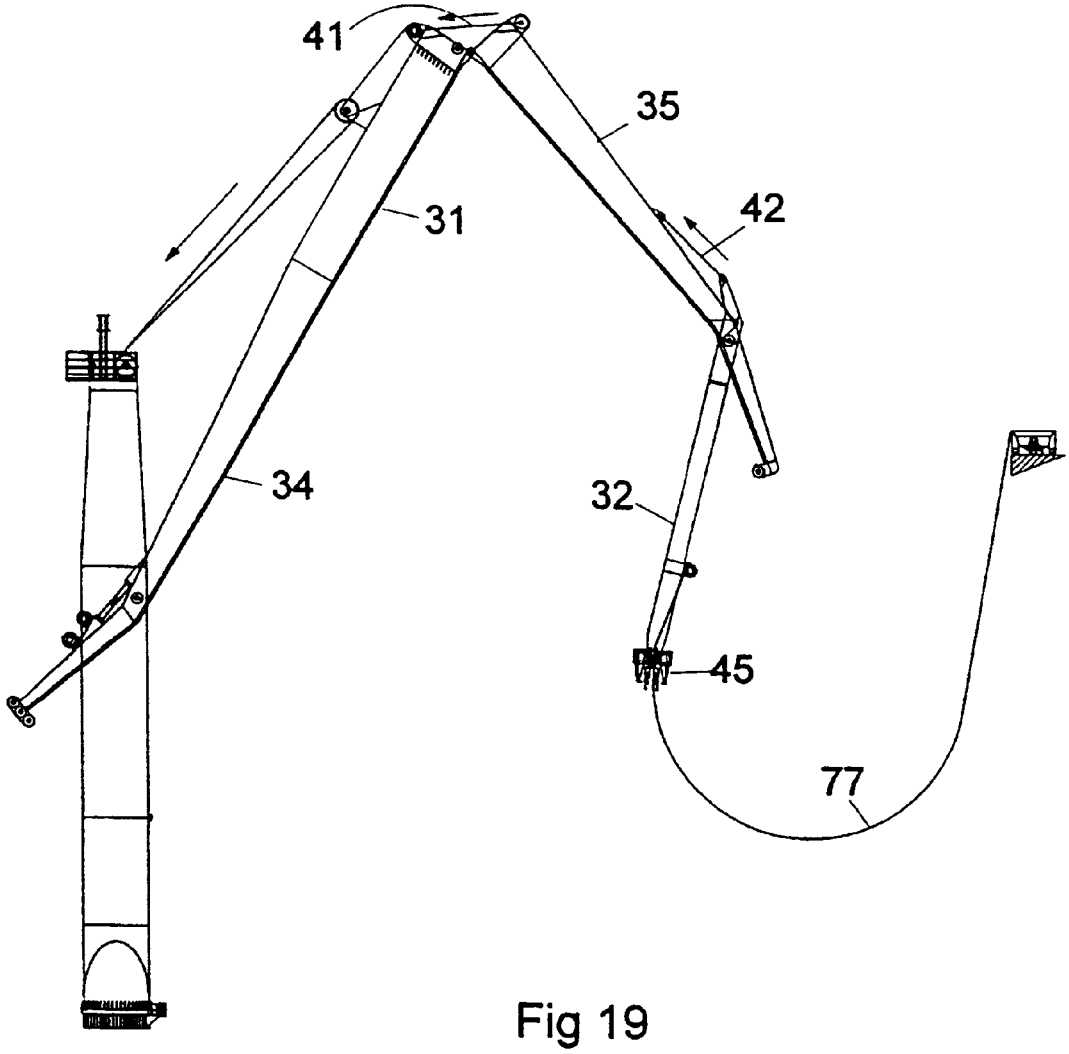

FIGS. 18*a–c* show bearing housing 49 for frame 32, consisting of a circular housing 49 having arms 48 supporting bearing 46 for the mounting of legs 47 of frame 32, and a pivot bearing 76. Bearing 76 is bolted to flange 65 (see FIG. 17*a*), so that it follows the movement of frame 32.

Figure 24:
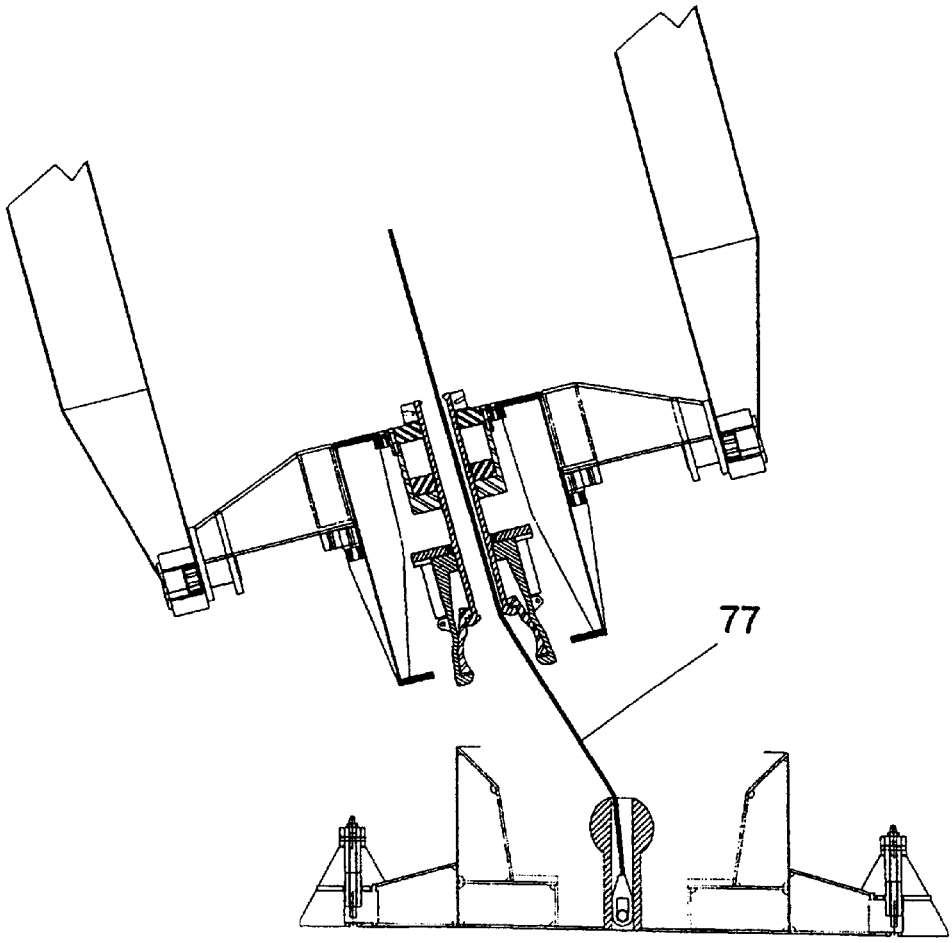

The establishment of a bridge connection between a ship and platform takes place according to the following procedure:

Footing 52 in accordance with FIG. 16 is locked beforehand to the platform deck: by rapid release mechanism 51 in accordance with FIG. 15, by the locking of locking pawls 56 around pins 62. The ship is put into position, and a wire 77 has beforehand been secured to footing 52 on the platform, as shown in FIG. 24. Wire 77 is threaded through bore 60 in ball 53 and through bore 71 in cylinder rod 67 and is attached to the winch V (see FIG. 19). This can be done on the deck of the ship while boom 31 is folded and frame 32 is laid down completely. The inner section 34 of boom 31 is then raised to maximum upright position, while outer section 35 of boom 31 remains folded and frame 32 descends to a vertical position when actuator 42 is disengaged.

Figure 20:
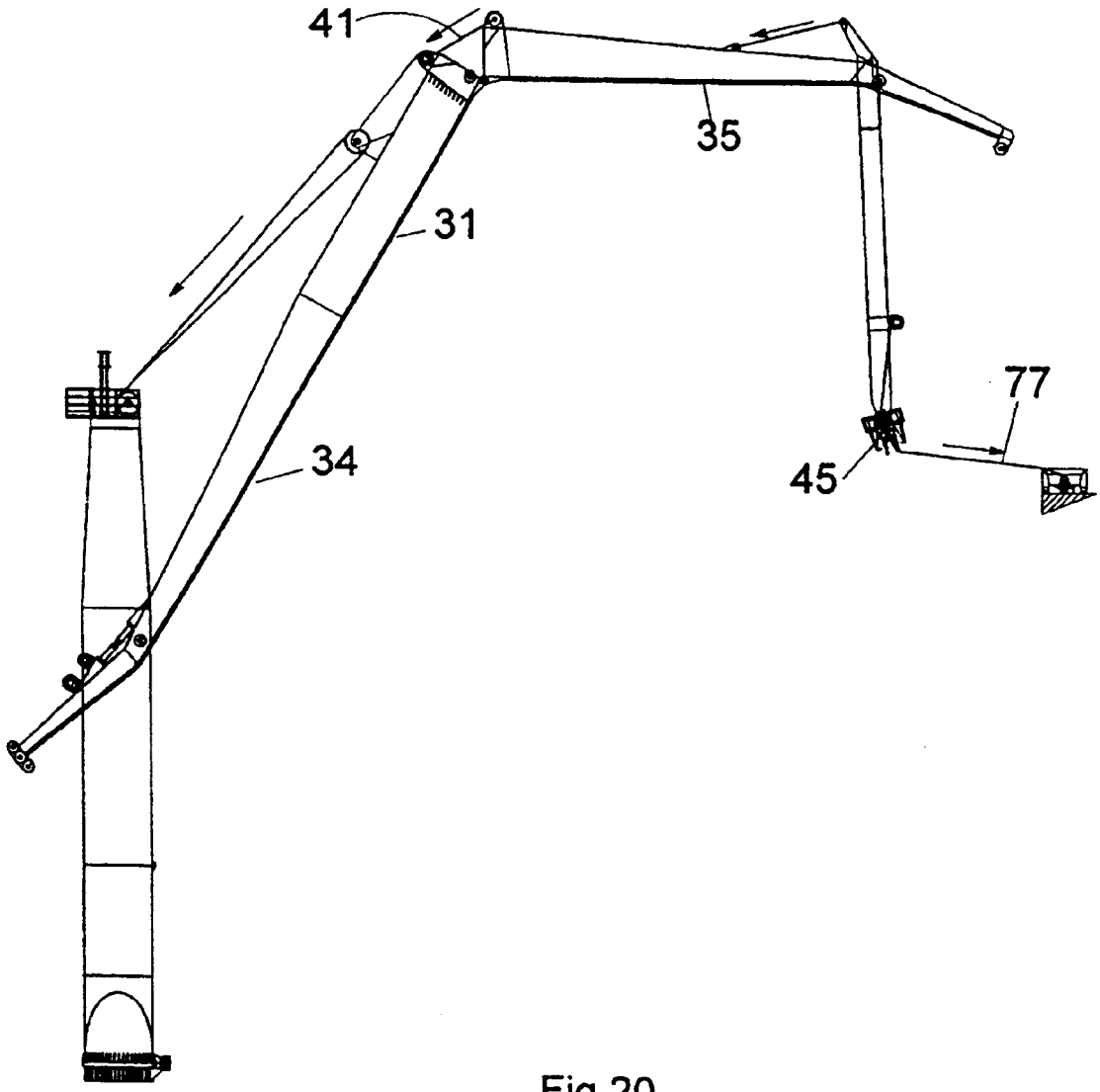
Figure 21:
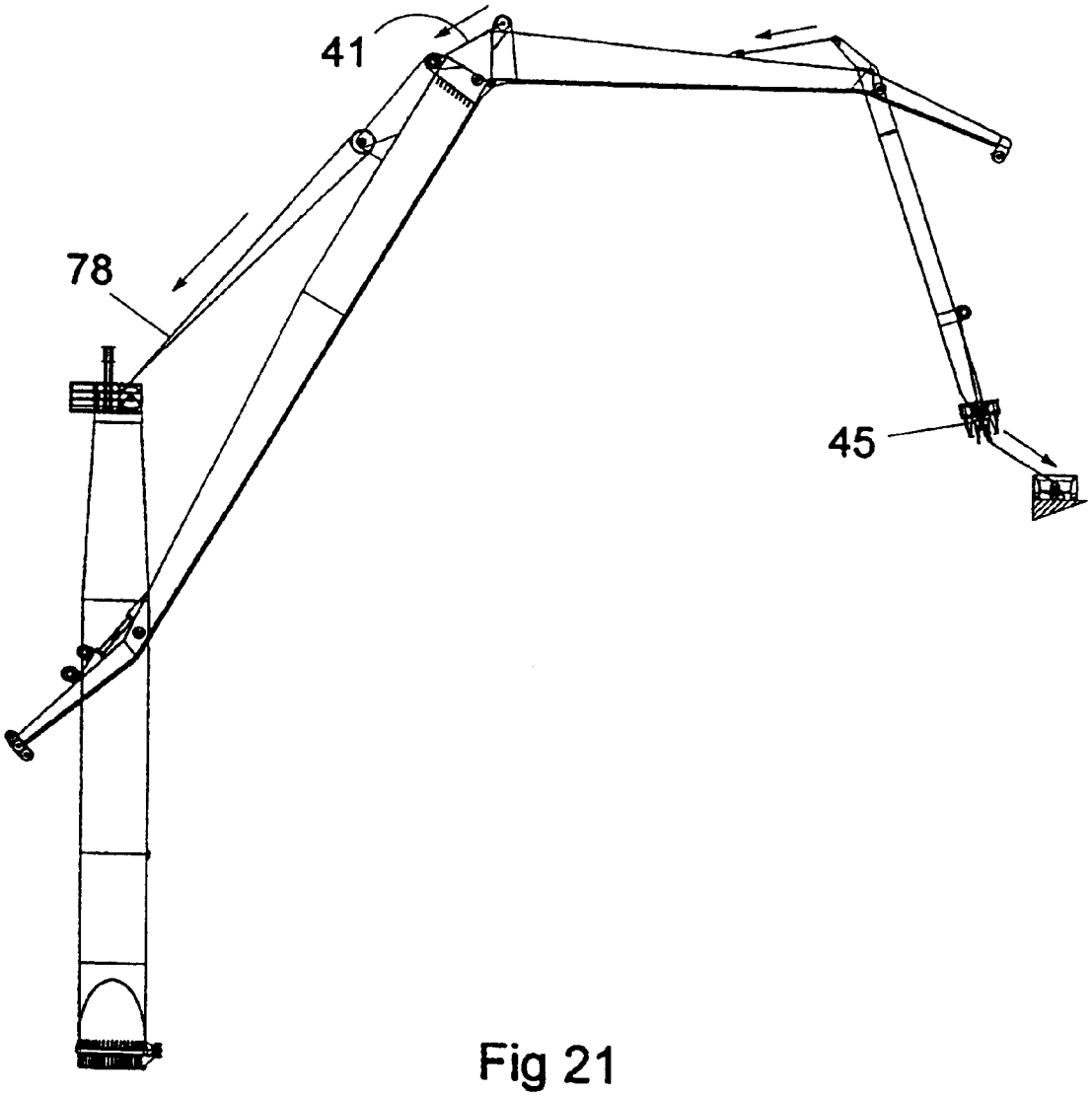

Winch V pulls in wire 77, and frame 32 is drawn toward a mechanical stopper on boom section 35 so that this is pulled along, and boom 31 is straightened (see FIG. 20). Actuator 41 is now activated, and boom 31 is straightened out so that coupling 45 is held above footing 52 on the platform (see FIG. 21).

Figure 22:
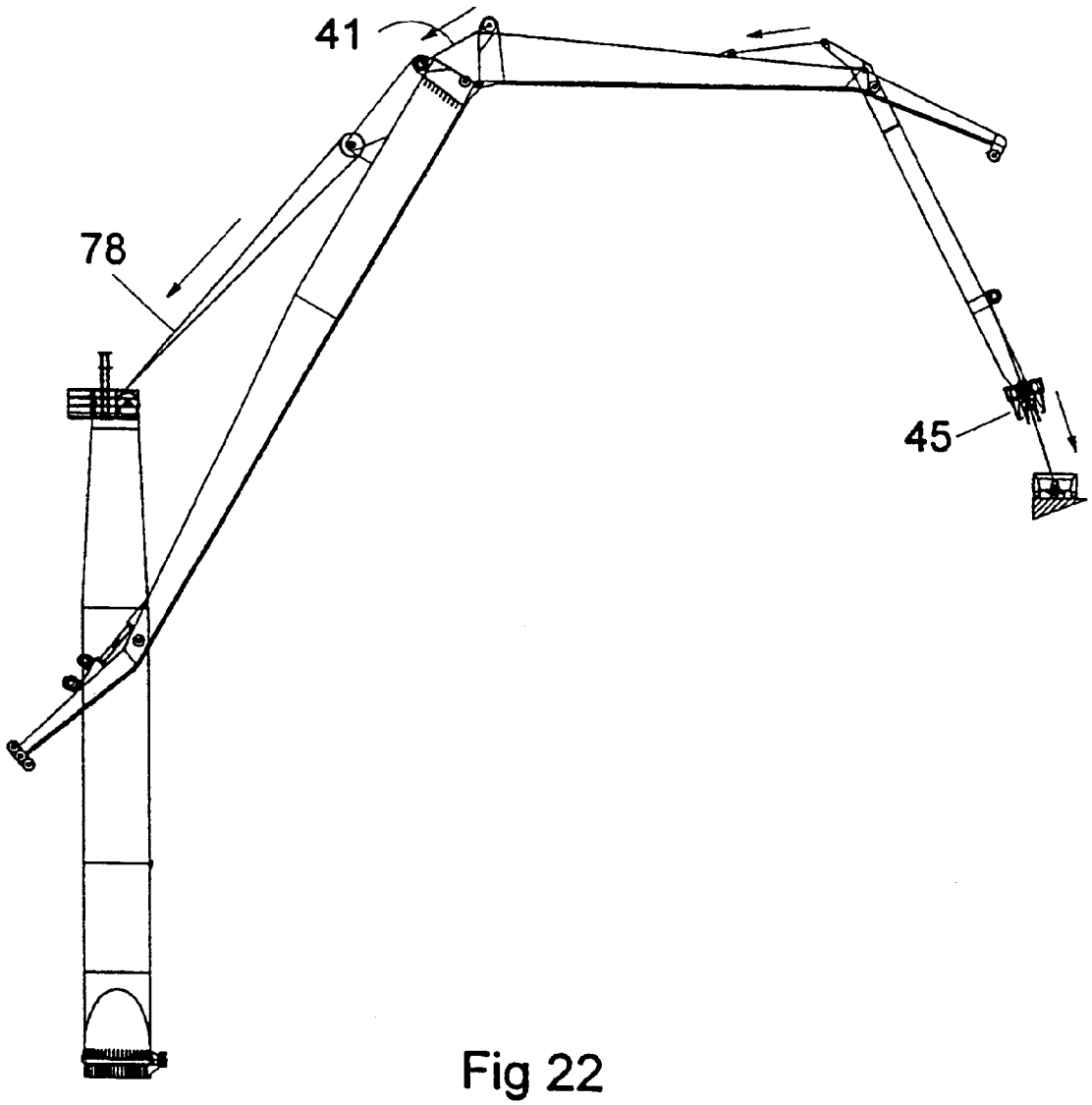
Figure 23A:
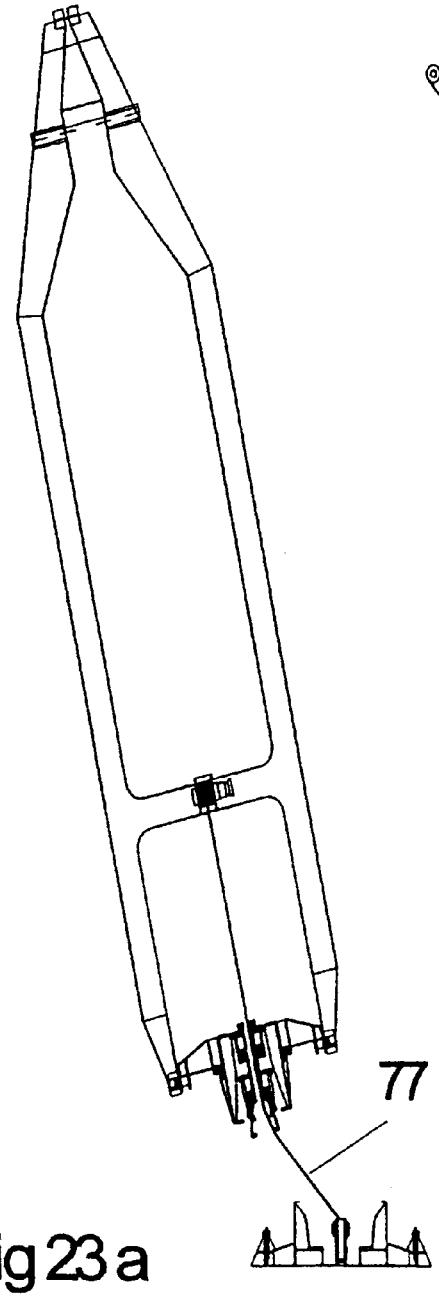
Figure 23B:
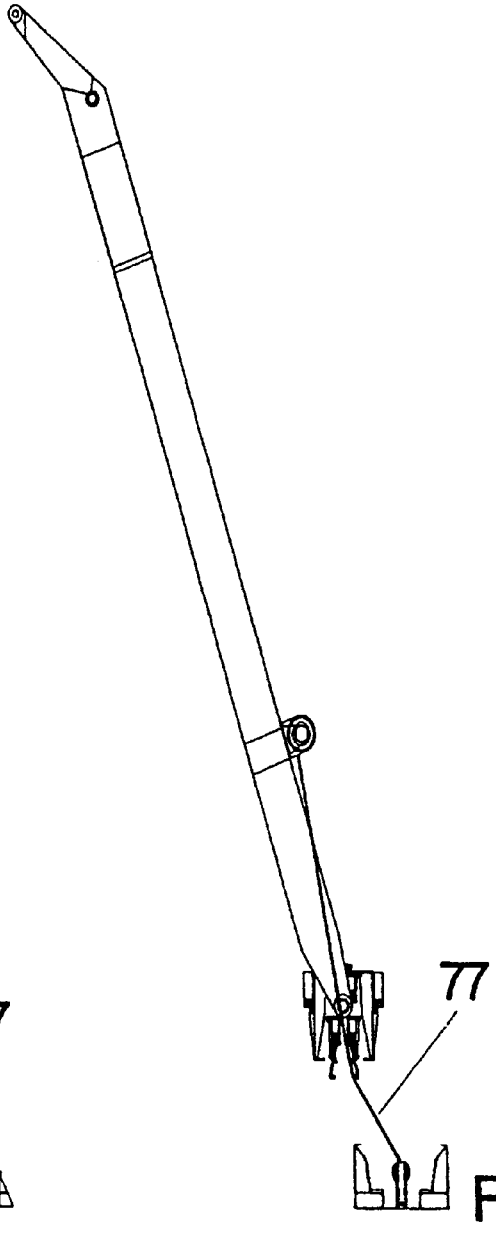
Figure 25:
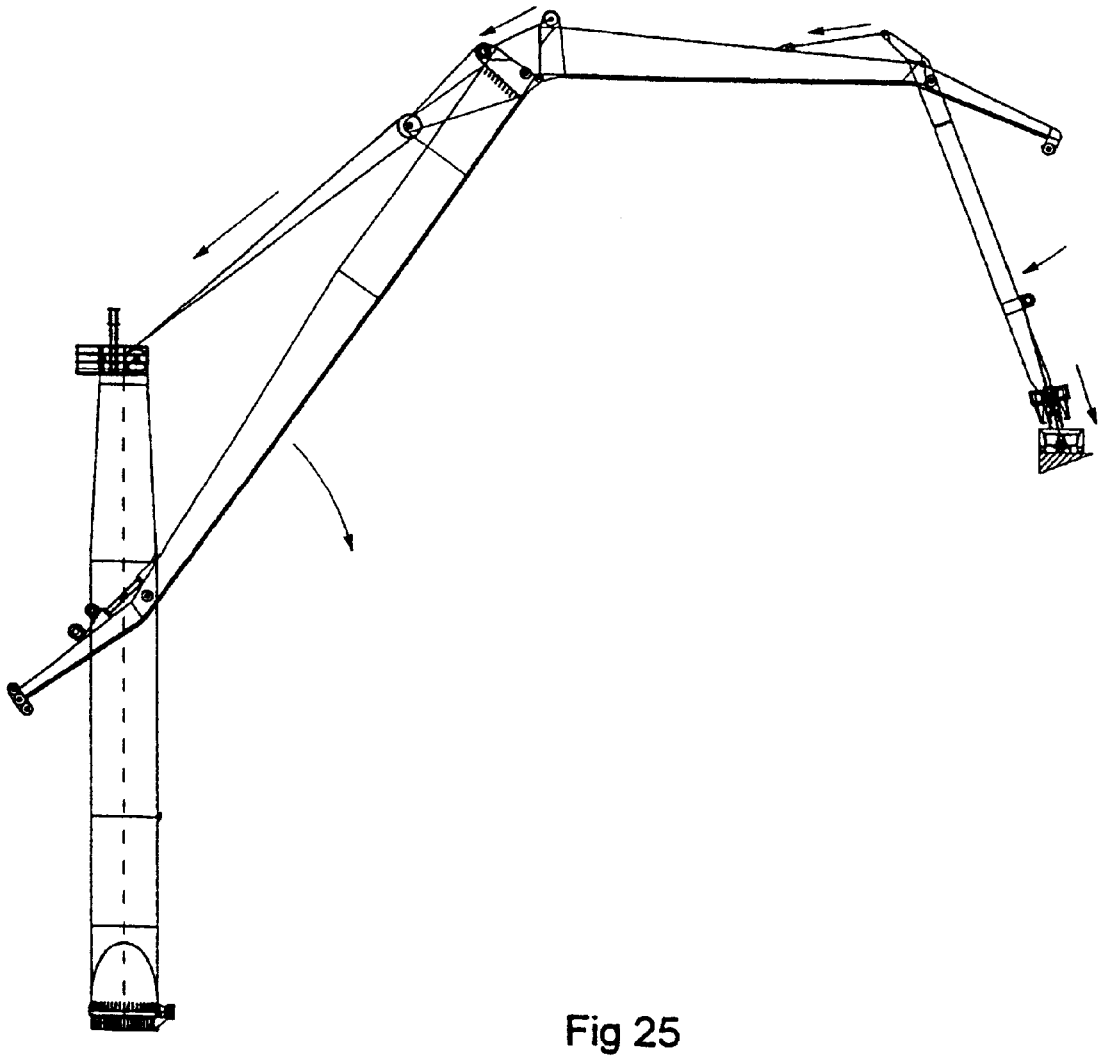
Figure 26:
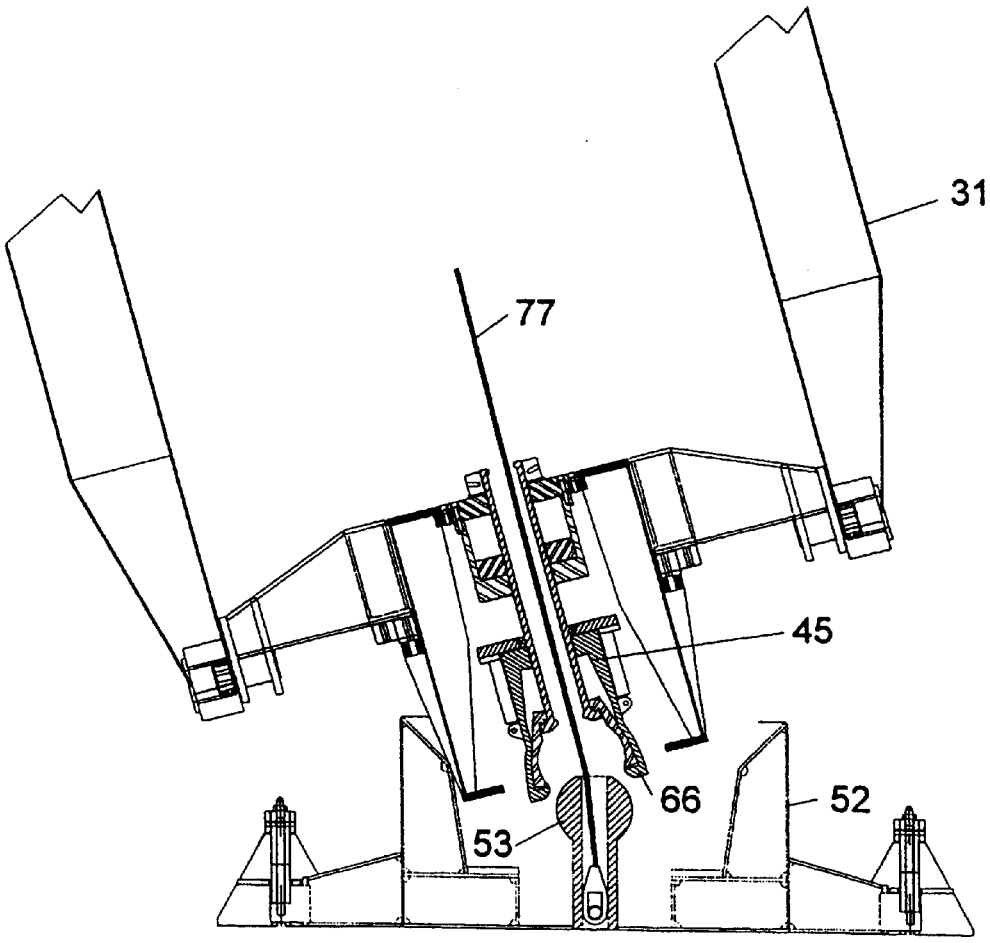
Figure 27:
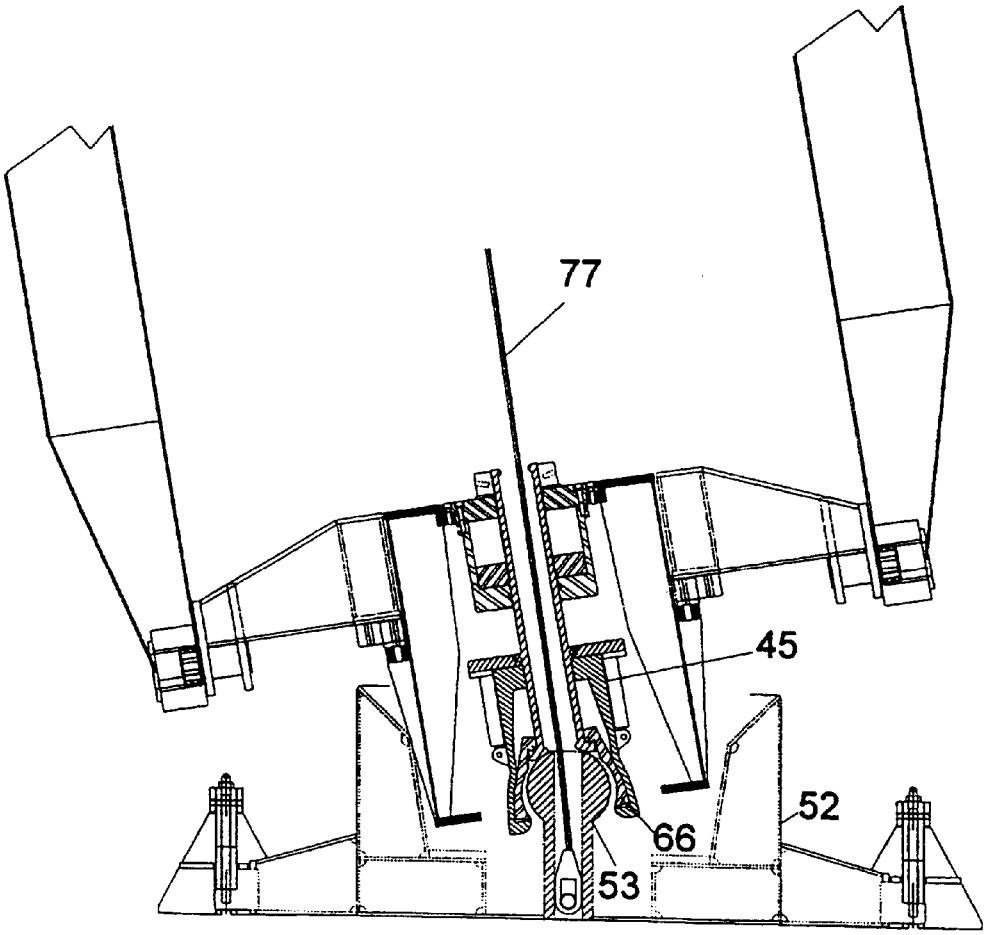

A boom lift actuator 78 and the boom joint actuator 41 maintain a constant force while winch V continuously draws coupling 45 toward footing 52 on the platform (see FIG. 22). FIGS. 23*a*, 23*b* and 24 illustrate the angular deviation and positional deviation that may be permitted for coupling 45 during the pull-in process. FIGS. 25 and 26 show the internal steering in footing 52 toward the outer part of coupling 45, which ensures the centering of locking dogs 66 against ball 53. FIG. 27 shows the situation where coupling 45 has been lowered onto ball 53 and is held in position by the tractive force of wire 77.

Figure 28:
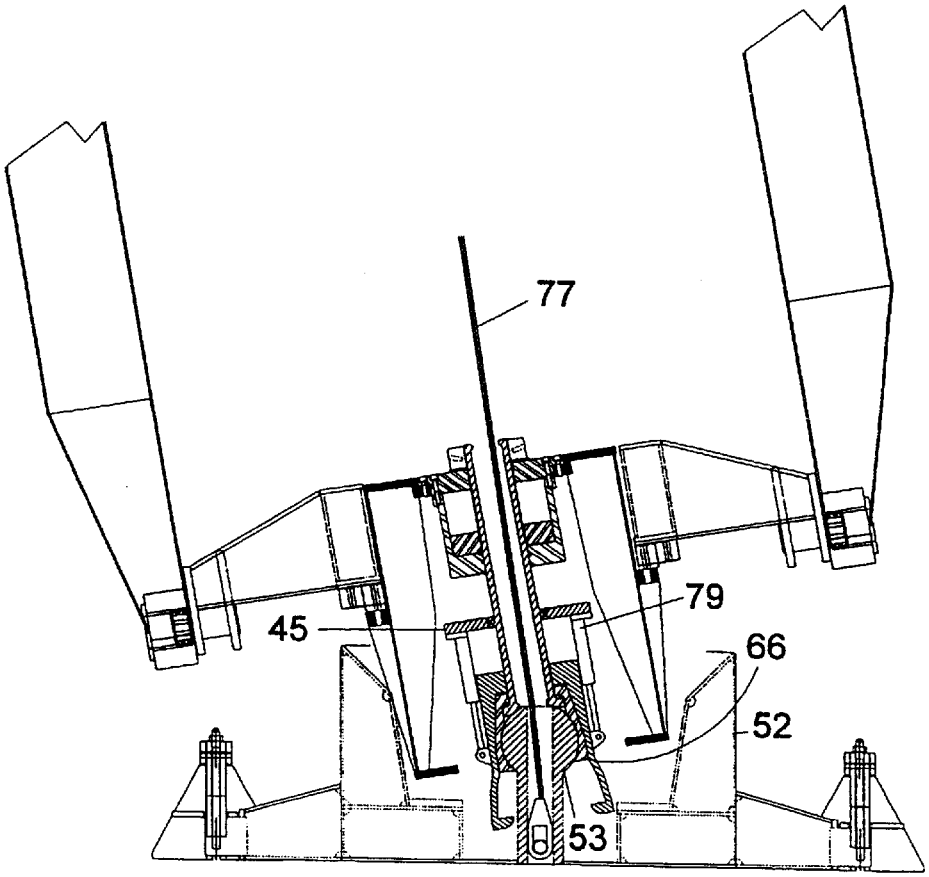

Actuator 79 in coupling 45 is activated, skirt 69 is pushed forward and locking dogs 66 secure the connection to the footing 52 (see FIG. 28).

Figure 29:
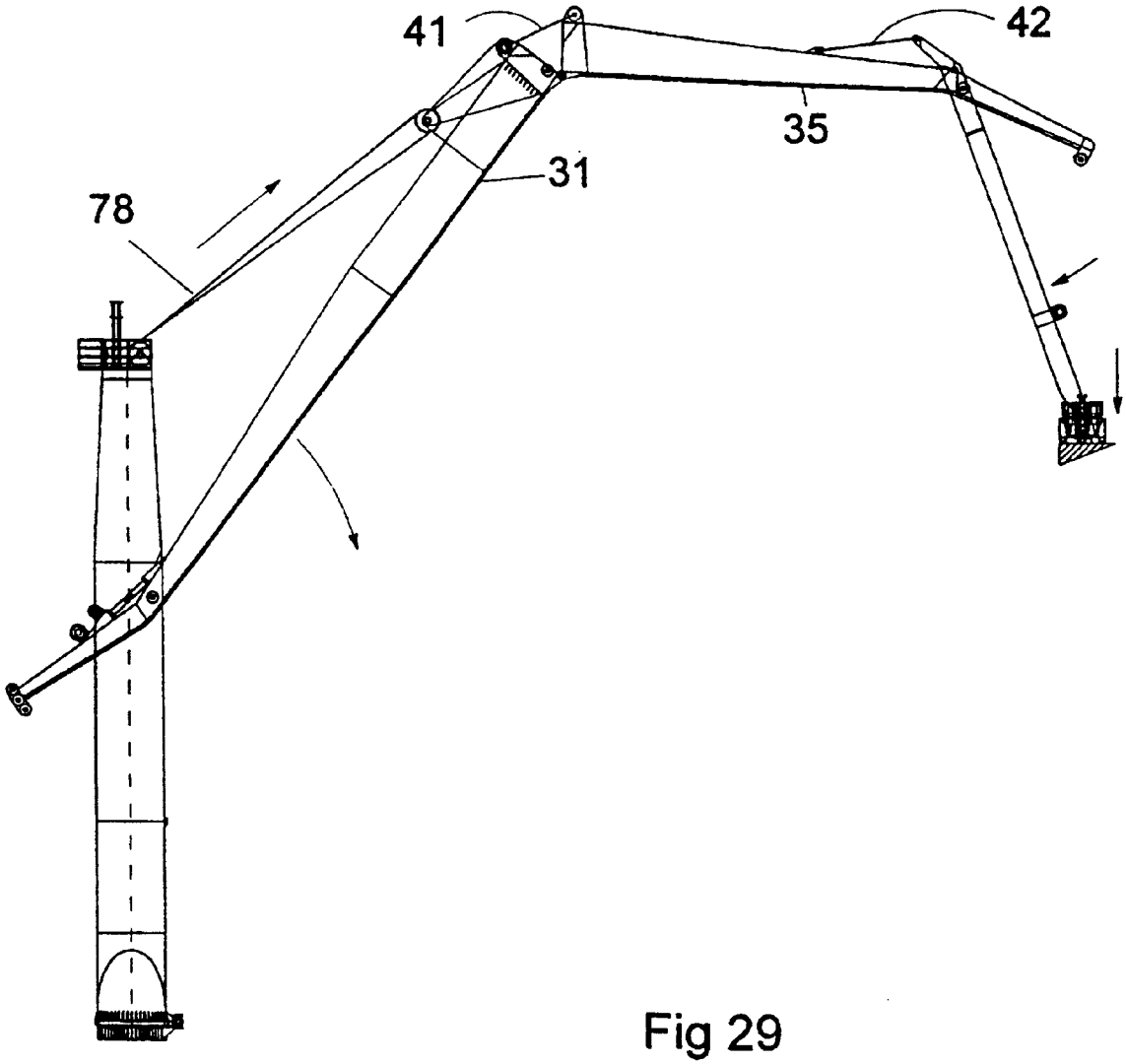
Figure 30:
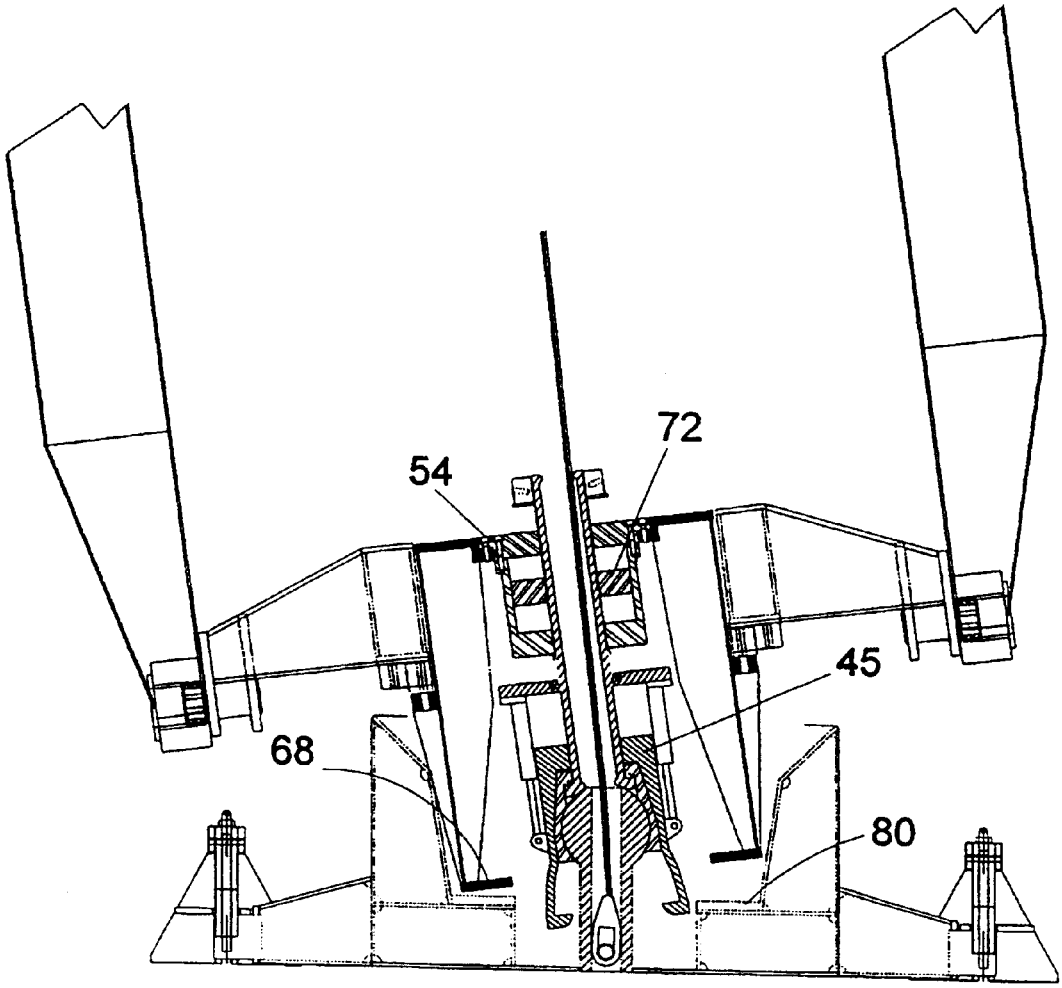
Figure 31:
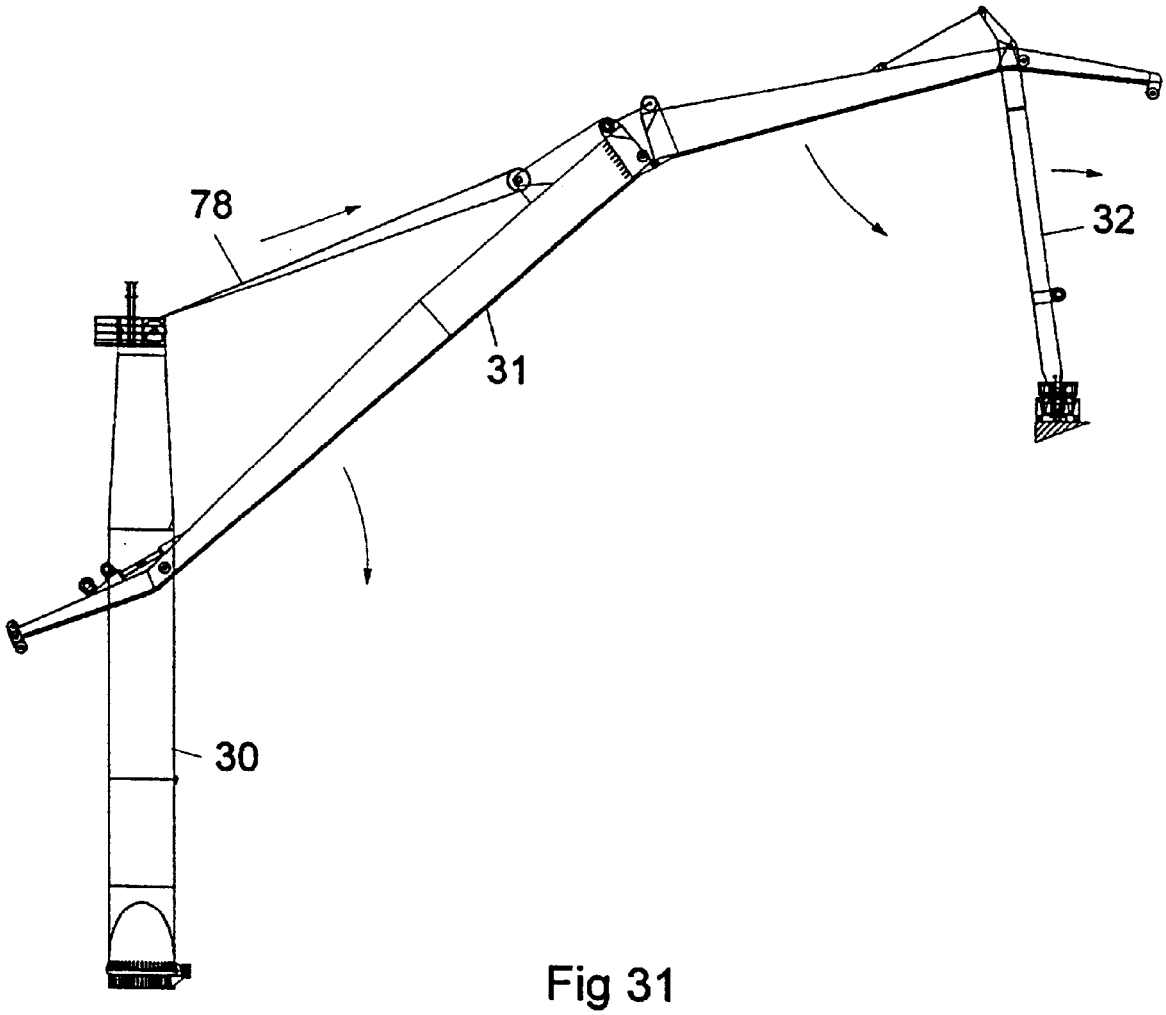
Figure 32:
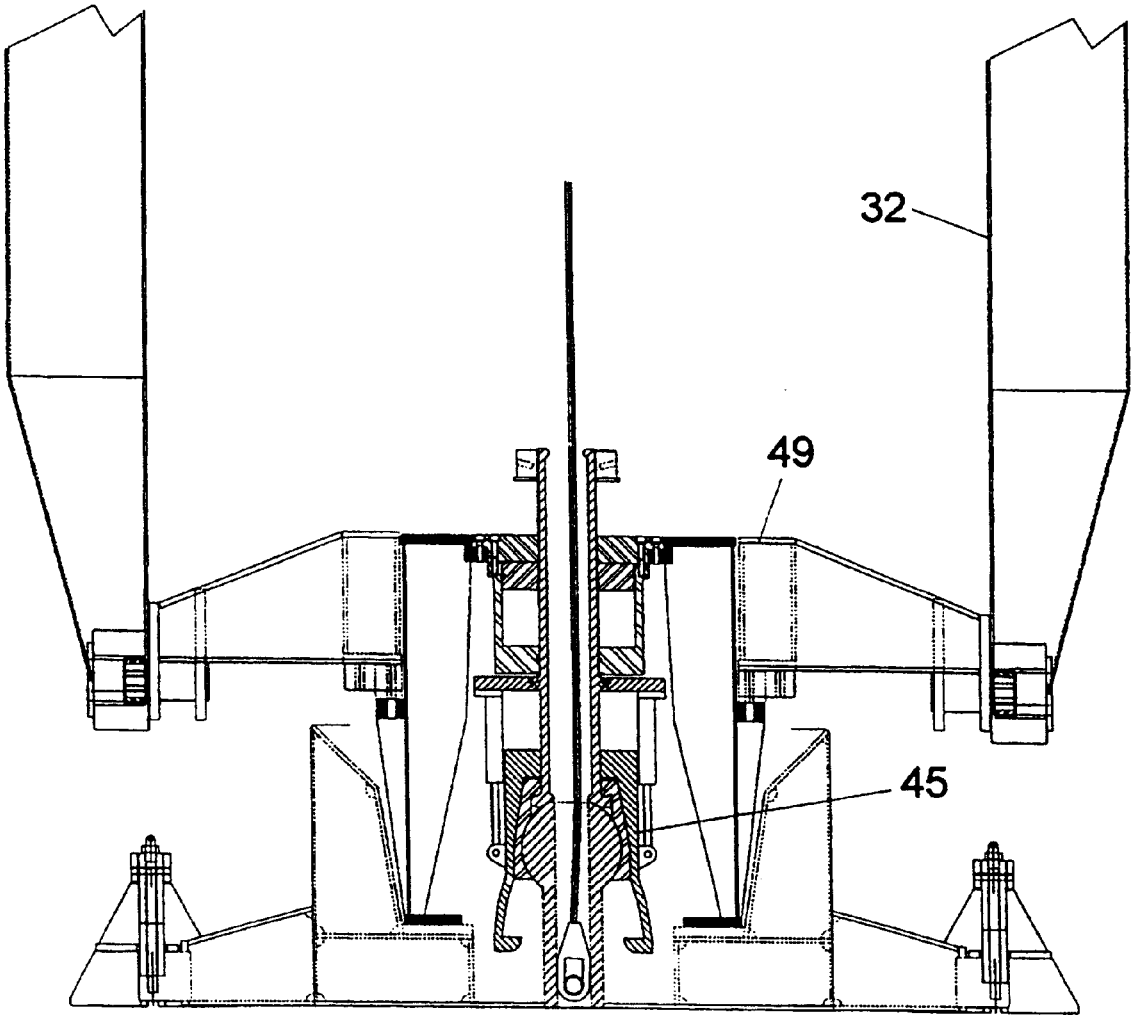
Figure 33:
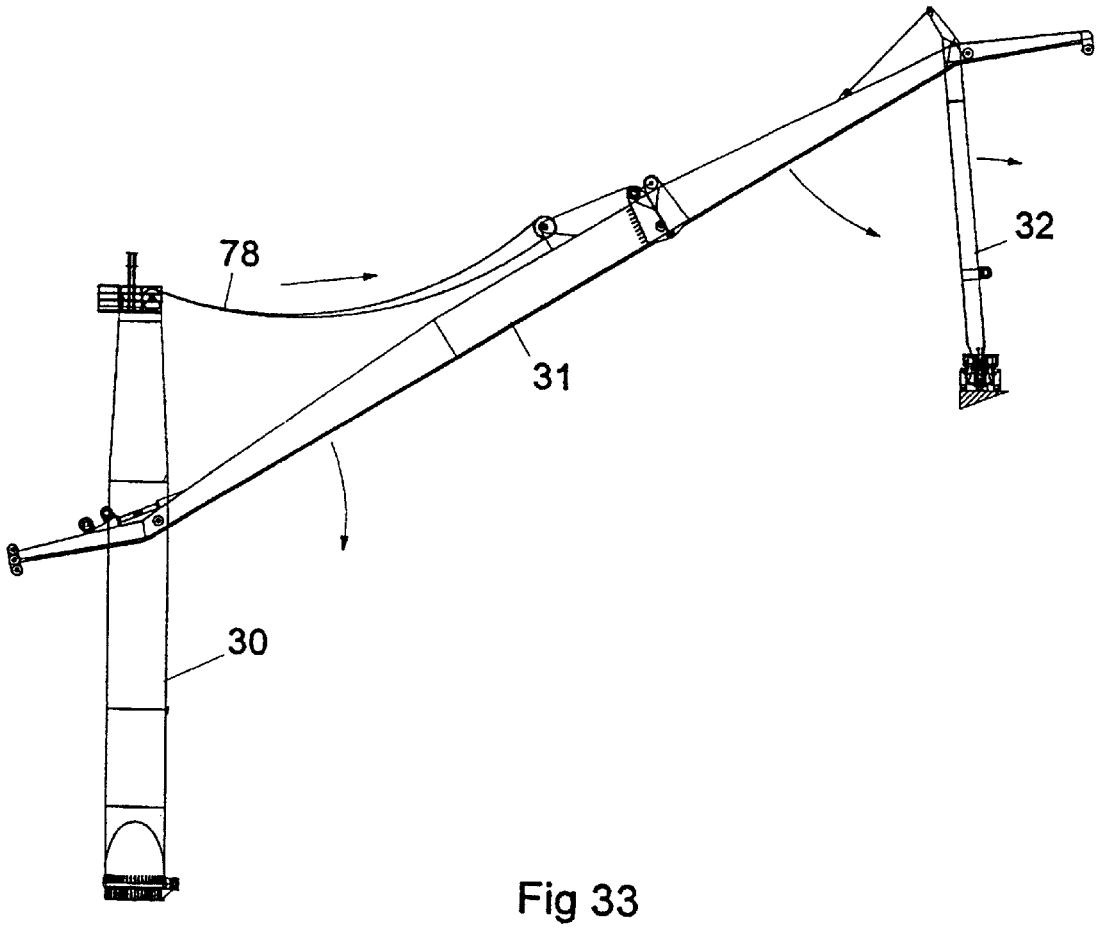

At the same time, boom joint actuator 78 and frame actuator 42 are disconnected, and boom actuator 41 begins to lower the outer boom section 35 on boom 31 (see FIG. 29). The pull-down cylinder 54 in coupling 45 is activated by applying pressure on the underside of piston 72 (FIG. 17*a*), which pulls terminal cap 75 downward so that landing flange 68 (FIG. 17*a*) meets the footing 52 (see FIG. 30). Pull-down cylinder 54 draws landing flange 68 toward a seat 80 in footing 52 such that coupling 45 with bearing housing 49 and frame 32 are straightened up to vertical position (see FIGS. 31 and 32), at the same time as inner section 34 on boom 31 is lowered to operational position (see FIG. 31), and boom lift actuator 38 is slackened completely so that boom 31 lies freely suspended in column 30 and in frame 32 (see FIG. 33).

Figure 34:
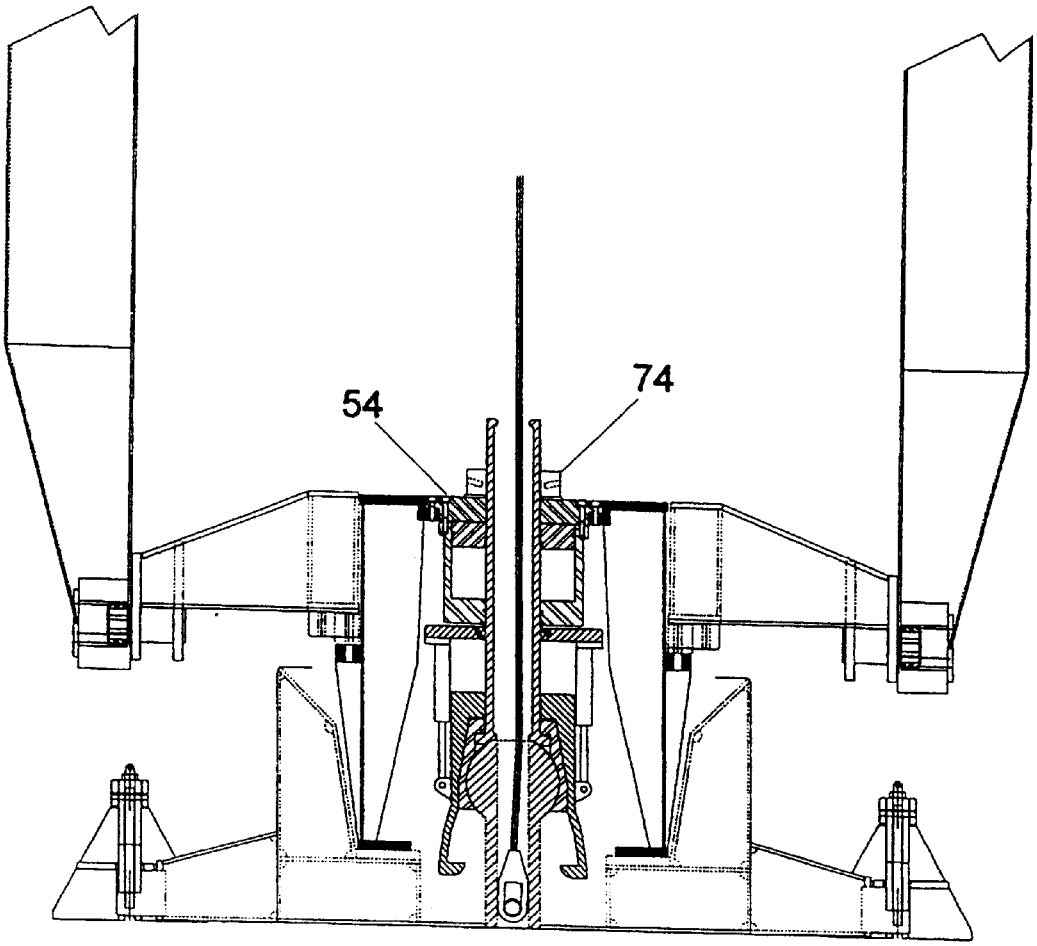
Figure 35:
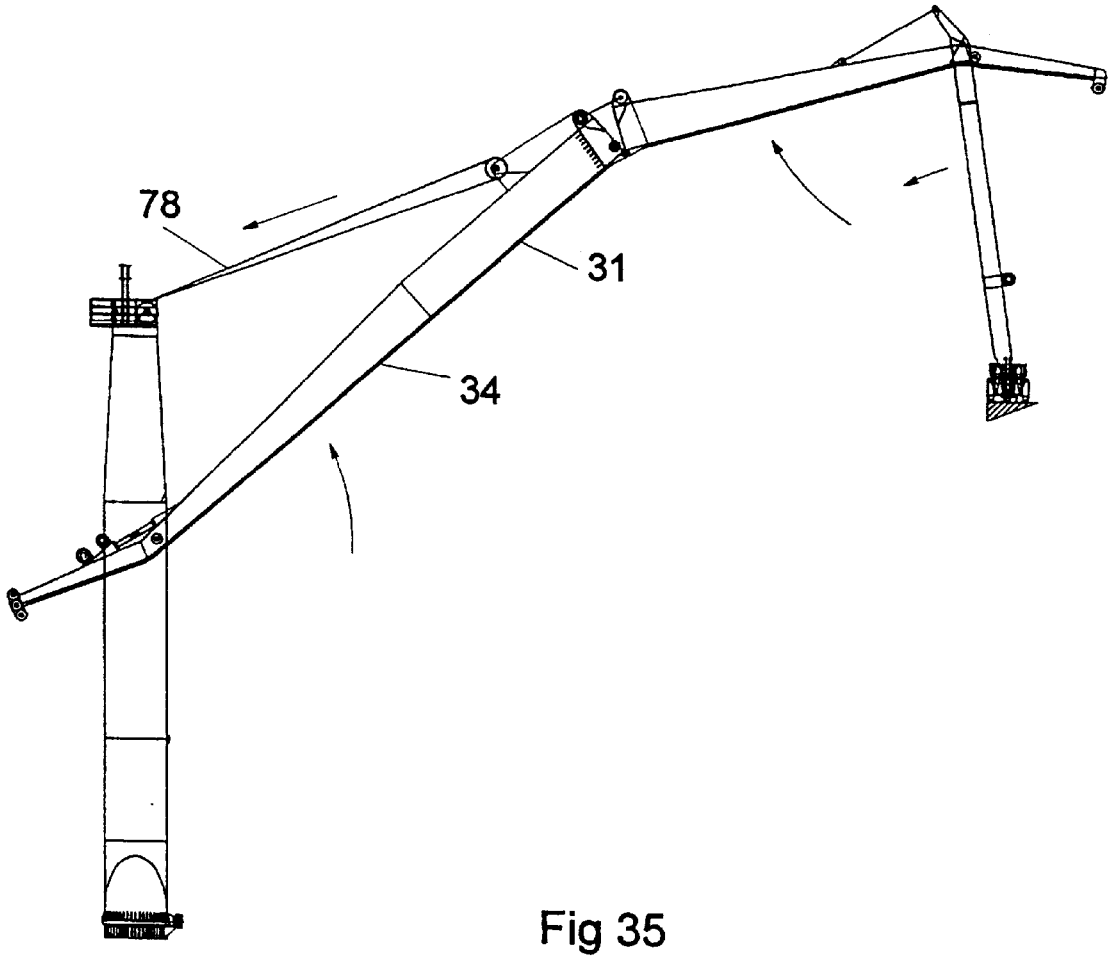
FIGS. 35–38 show stages of a normal disconnection procedure.
Figure 36:
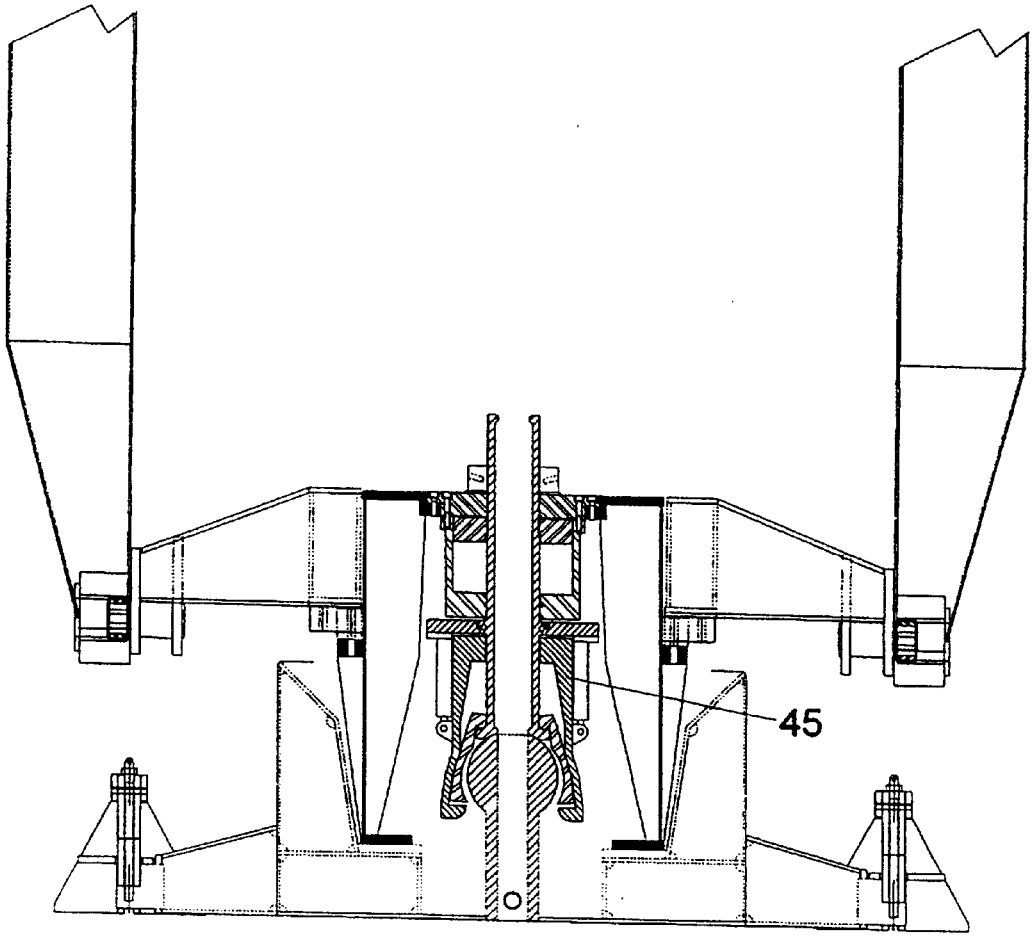
Figure 37:
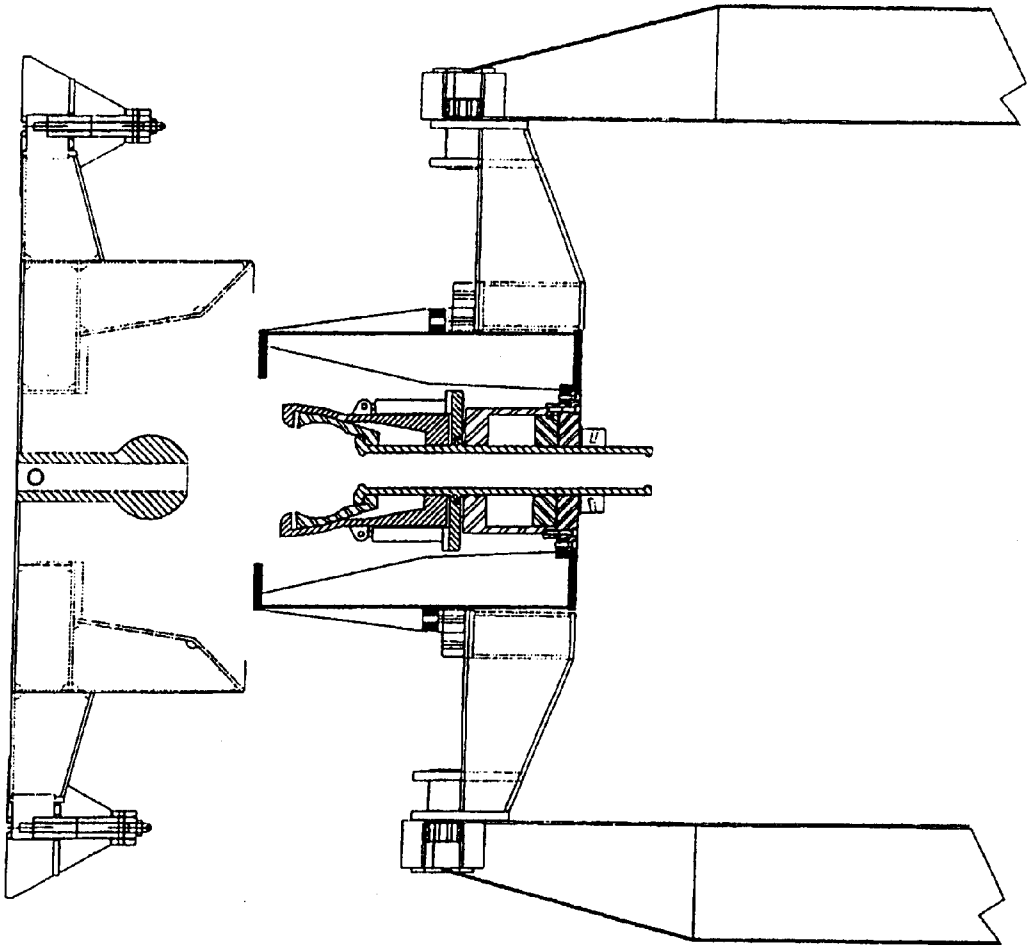
Figure 38:
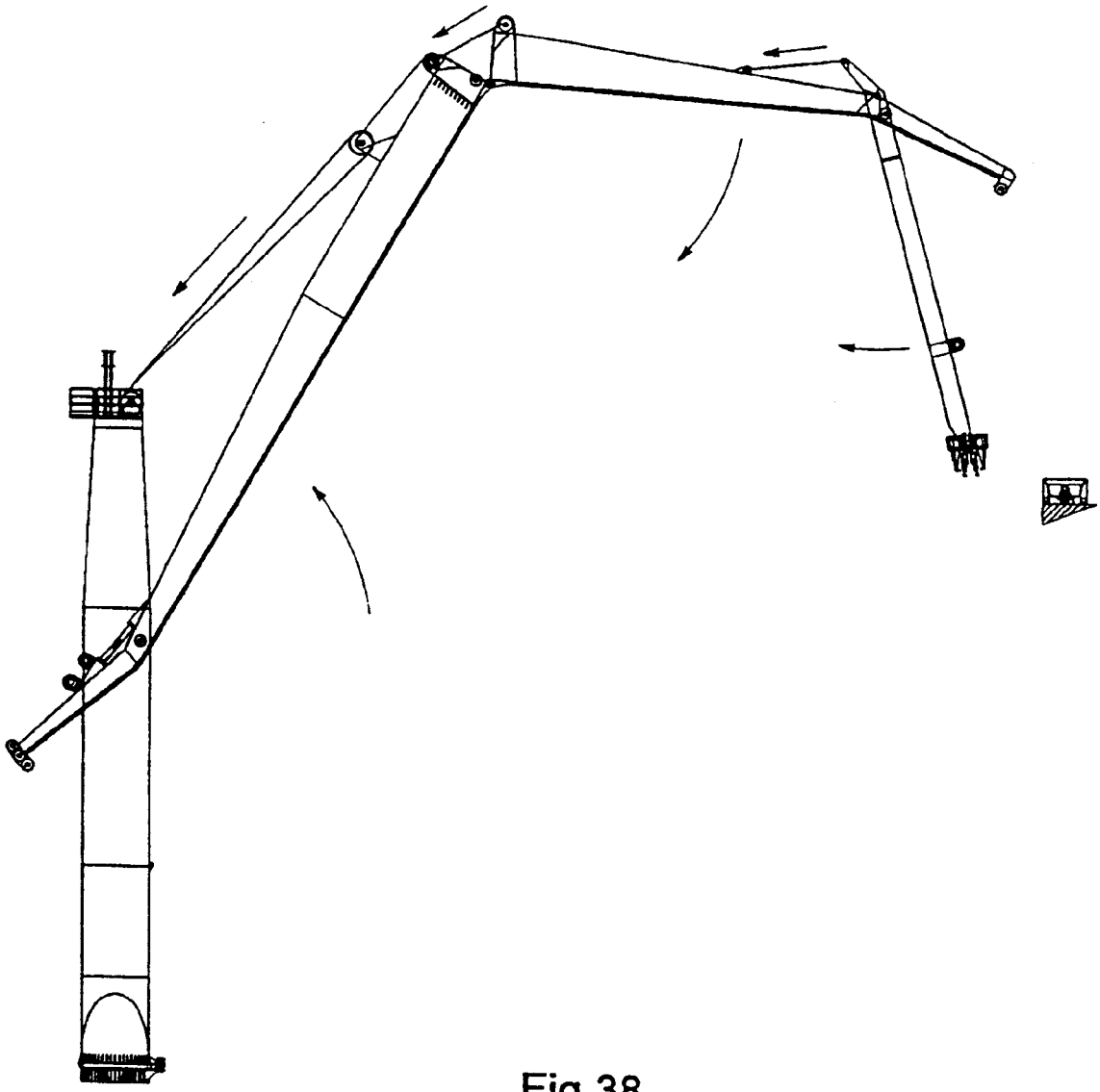
Figure 39:
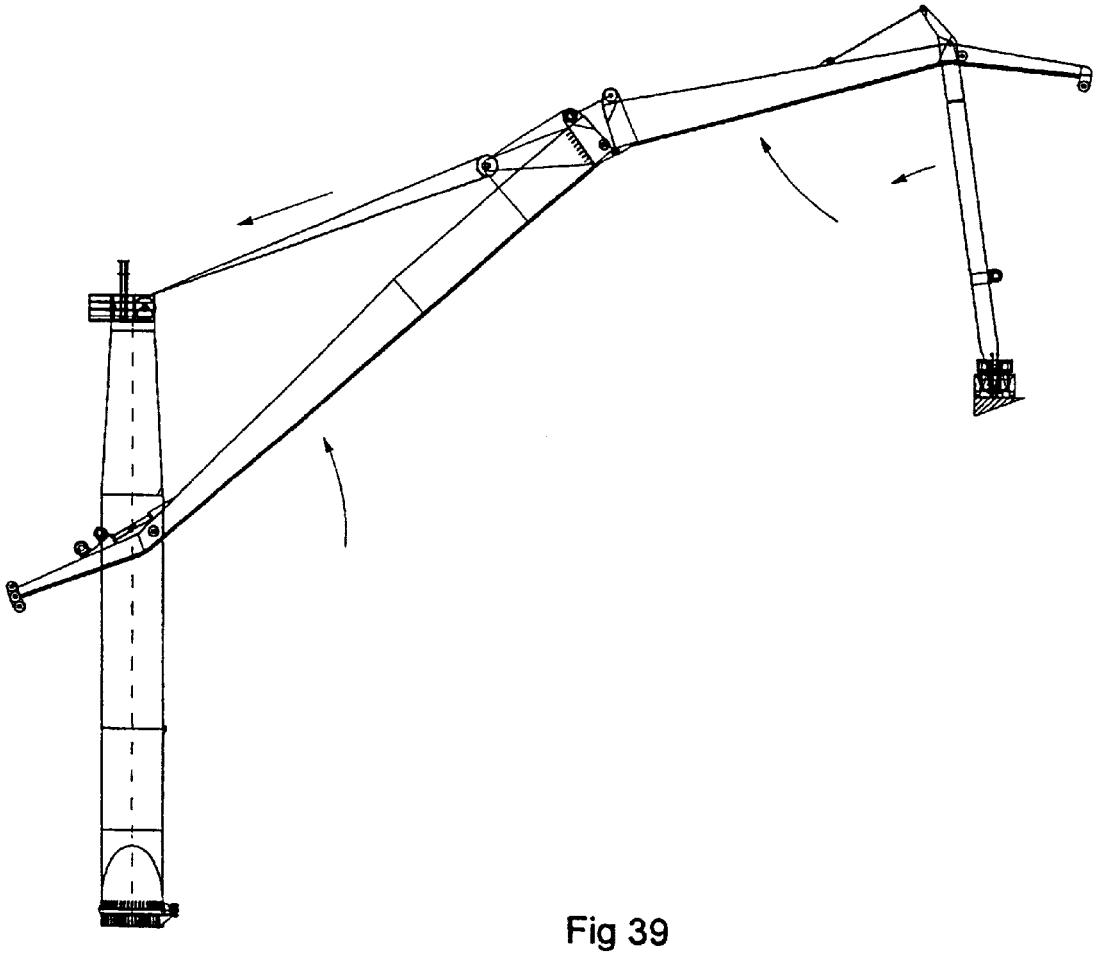
FIGS. 39–43 show stages of an emergency disconnection.
Figure 40:
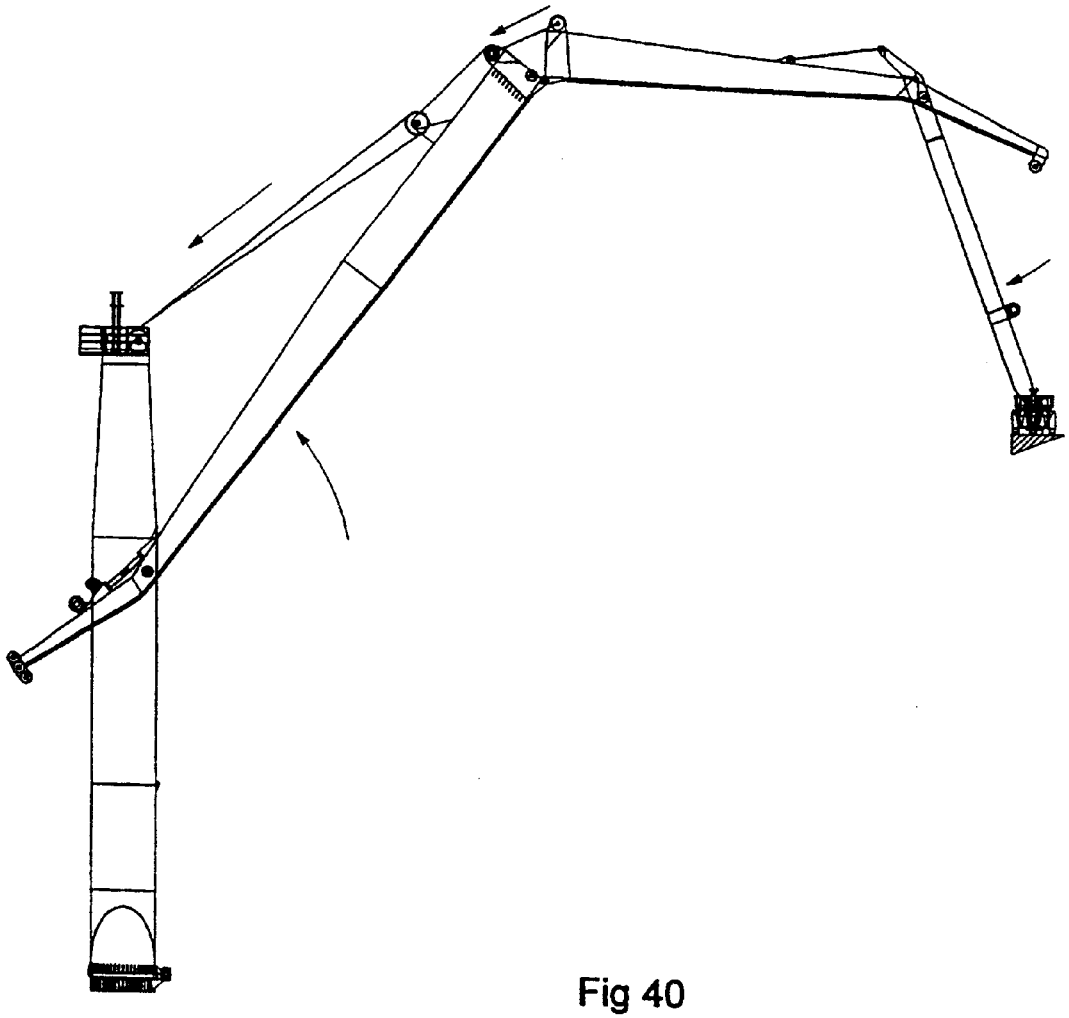

Nut 74 is tightened manually, and the pressure for pull-down cylinder 54 is drained so that the anchoring is mechanically secured (see FIG. 34).

A normal disengagement procedure will be as follows: boom lift actuator 78 is activated so that the inner section 34 of boom 31 is raised, constant force on boom joint actuator 41 is activated (see FIG. 35), coupling 45 is opened (see FIG. 36), coupling 45 is lifted clear when boom 31 is in a sufficiently upright position (see FIGS. 37 and 38) and the ship is immediately driven away.

Figure 41:
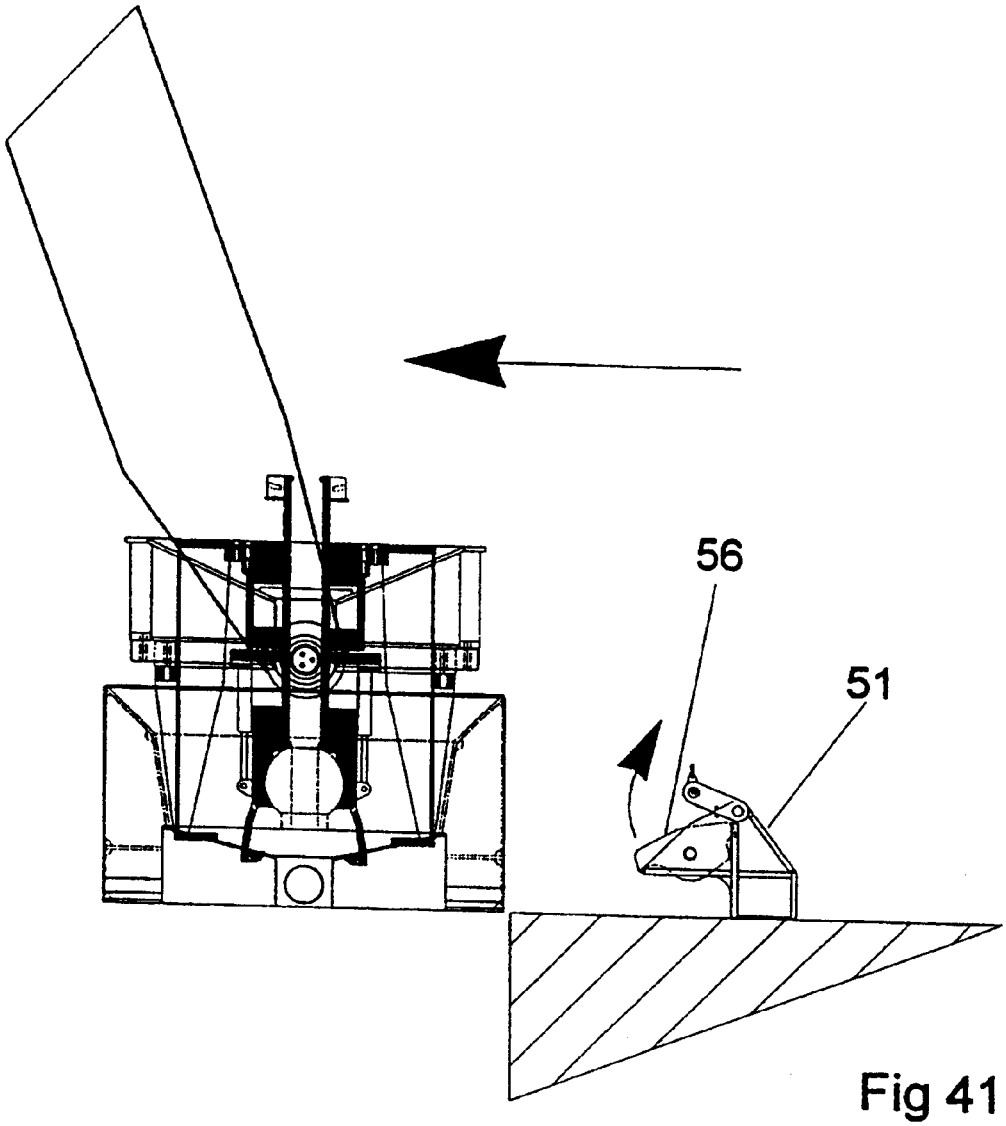
Figure 42:
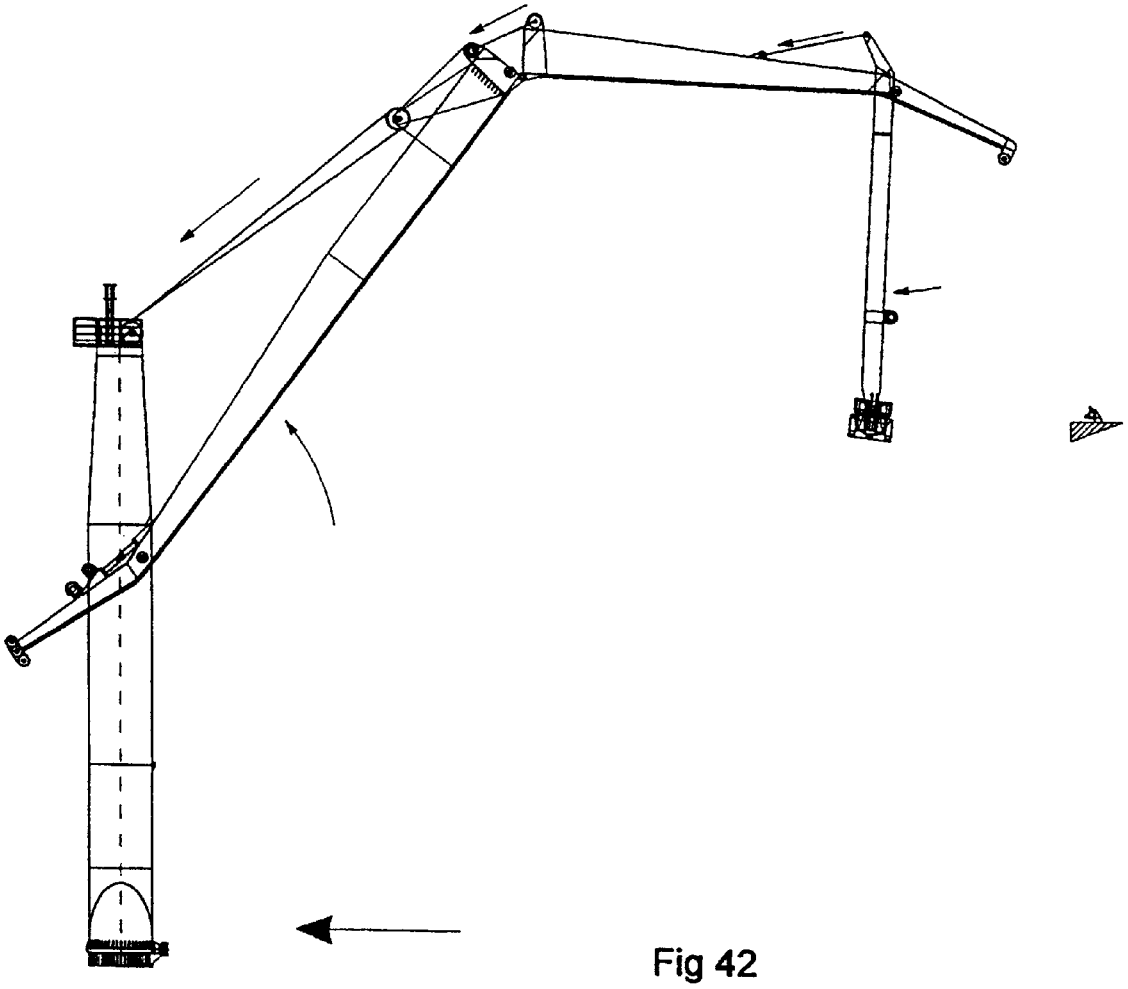
Figure 43:
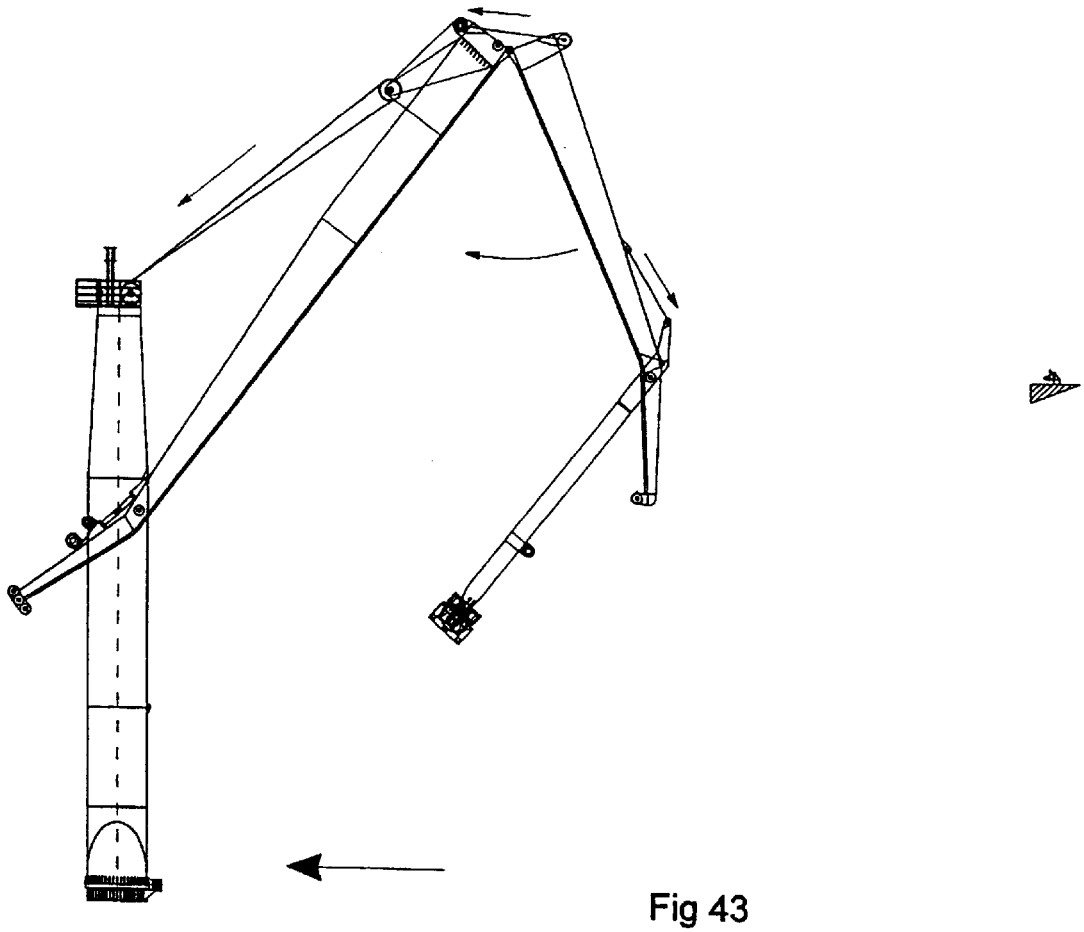

Rapid disengagement in an emergency situation will be as follows: boom lift actuator 78 is activated so that inner section 34 of boom 31 is raised, constant force on 41 is activated (see FIGS. 39 and 40), and pawls 56 in rapid release mechanism 51 are opened (see FIG. 41). The ship drives away from the platform at the same time as boom lift actuator 41 raises boom 31 and constant force is activated on frame actuator 42 to dampen the rotation of frame 32 as footing 52 leaves the platform (see FIG. 42). Boom 31 is folded and the system is driven into stowed position on deck (see FIG. 43).

In the above mentioned description, gangway 33 is not shown in order to avoid making the drawings unnecessarily complicated. Gangway 33 is brought up and lowered down by the use of a hoisting and conveyance system 81 after the connection between ship and platform via boom 31 and frame 32 has been established. FIGS. 44–47 show the disengagement of gangway 33, with the engagement being carried out in the same manner, but in the opposite sequence.

Figure 44:
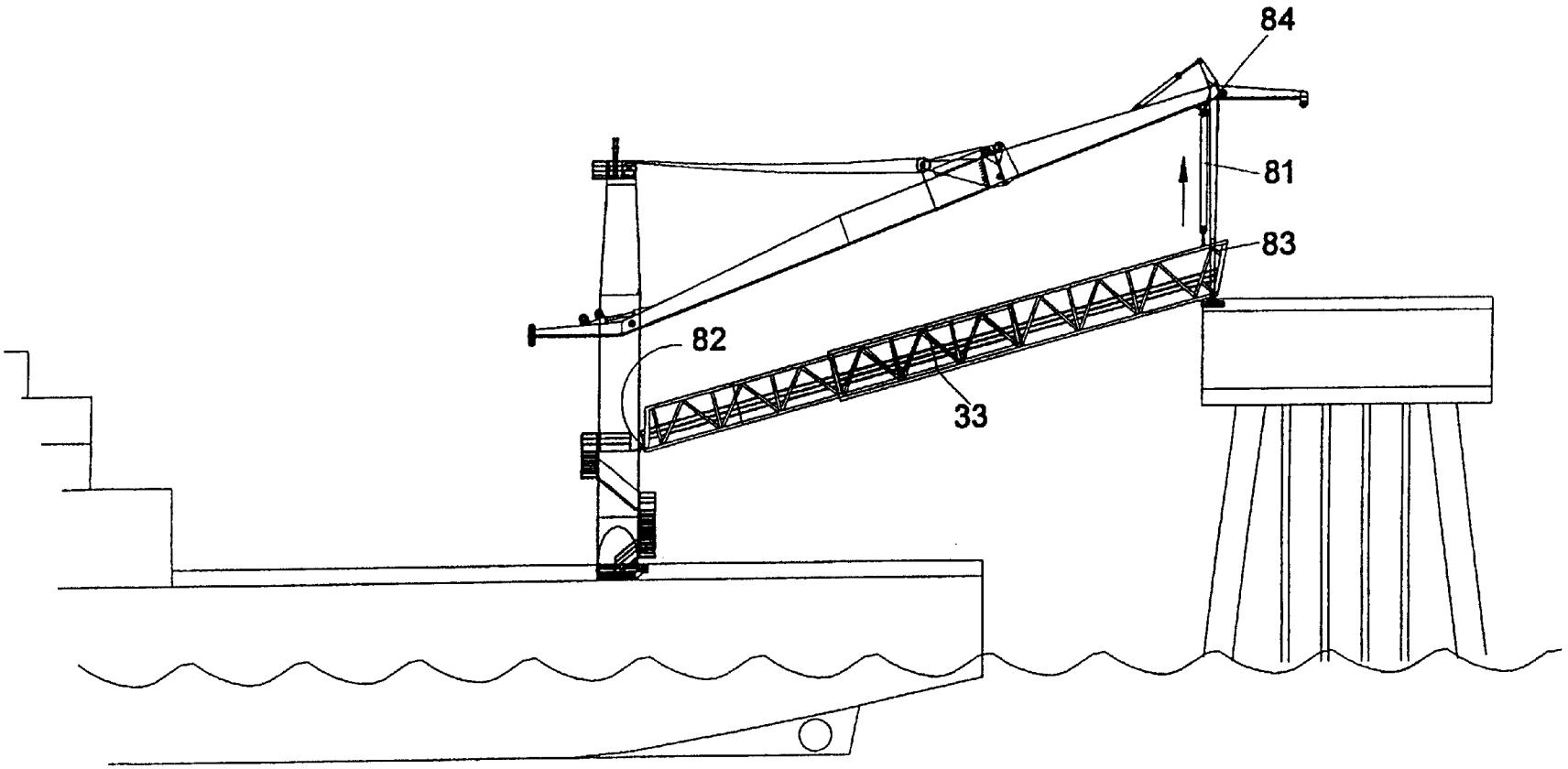
FIGS. 44–47 show stages in disconnecting and stowing the gangway.
Figure 45:
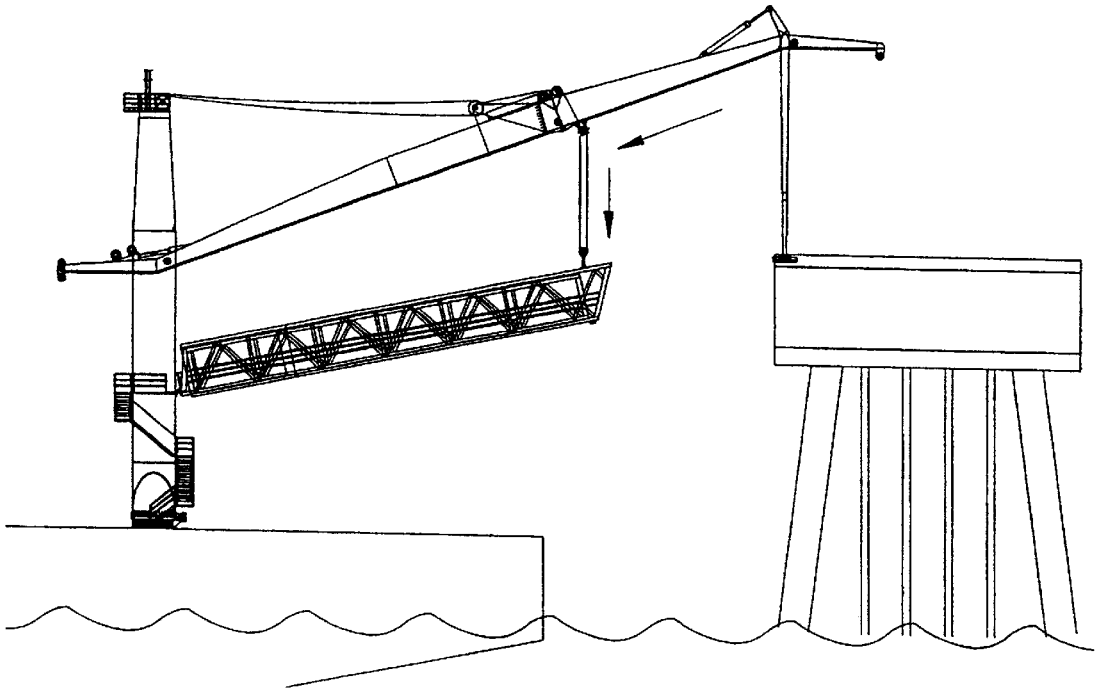
Figure 46:
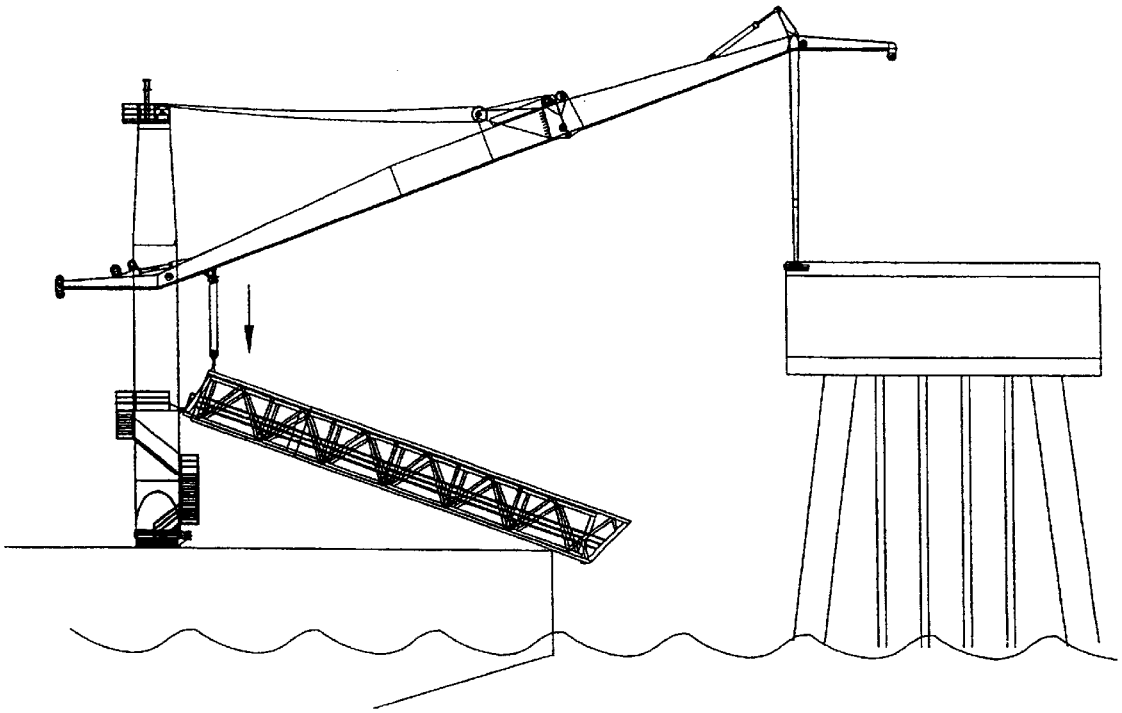
Figure 47:
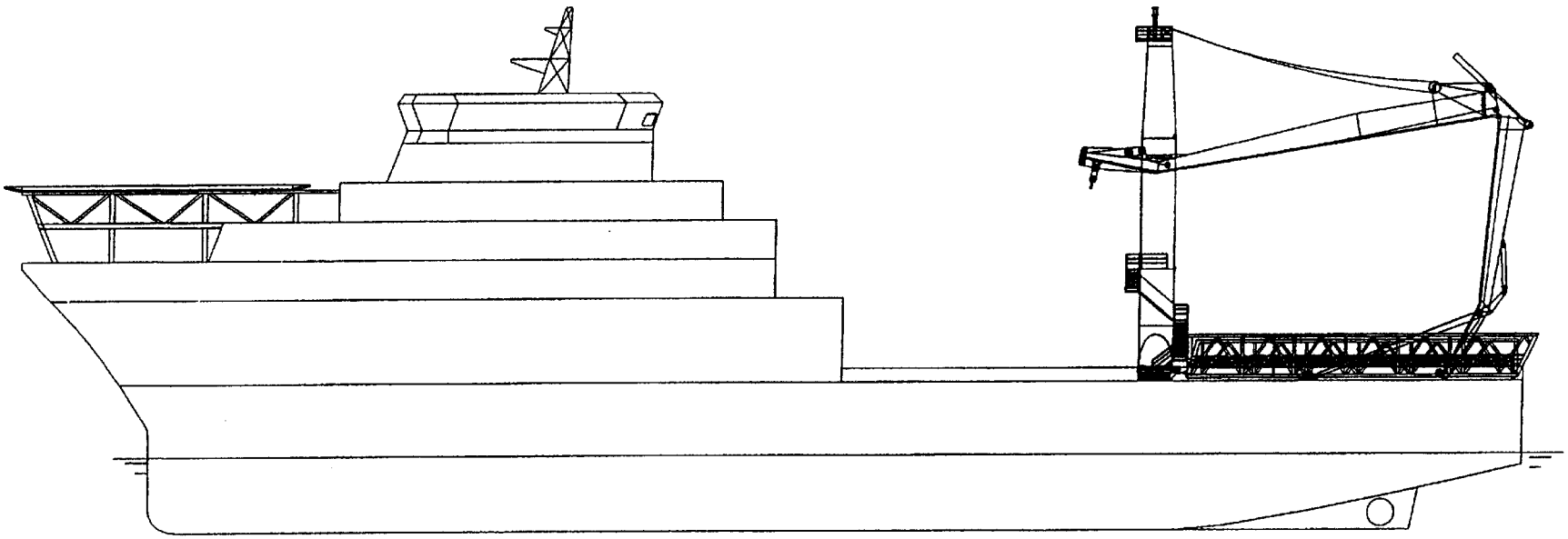

As shown in FIG. 44, gangway 33 is suspended from column 30 at the inner end 82 thereof and in frame 32 at the outer end 83 thereof. When gangway 33 is to be disengaged, its outer end 83 is connected to a trolley or travelling winch 84, which is adapted to run along boom 31. Gangway 33 is lifted out of engagement with frame 31 and trolley 84 moves gangway 33 telescopically toward column 30 (see FIG. 45).

When gangway 33 has been telescoped completely, trolley 84 drives further, with its point of attachment in gangway 33 rolling along gangway 33 until trolley 84 has arrived at the end position at column 30. During this process, the outer end of gangway 33 is lowered onto the ship's deck (see FIG. 46). Finally, the inner end of gangway 33 is also lowered onto the deck.

What is claimed is:

1. A motion absorbing conveyance system (1) for transferring personnel and/or objects between a floating vessel (2) and an installation (20), wherein the vessel (2) and the installation (20) exhibit a relative movement, which system (1) comprises a boom (7, 31), provided with an articulated connection to the one of the vessel (2) and the installation (20), and a variable length gangway (6, 33), having an articulated connection to the same one of the vessel (2) and the installation (20), and a frame (8, 32) which joins together the ends of the boom (7, 31) and the gangway (6, 33) opposite to the articulated connection, wherein there is provided on the other of the vessel (2) and the installation (20) one of a ball seat (19, 45) and a ball (18, 53), and wherein at the outer end of the gangway (6, 33) or at the lower end of the frame (8, 32) there is provided the other of the ball seat (19, 45) and the ball (18, 53), which is engageable with the one of the ball seat (19, 45) and the ball (18, 53) on the other of the vessel (2) and the installation (20), such that the ball/seat connection accommodates triaxial relative movement between the vessel (2) and the installation (20), characterized in that the ball (18, 53) and/or the ball seat (19, 45) comprises a through-going, hole (28, 60) for a pull-down wire (27, 77), which is connectable to the other of the ball seat (19, 45) and the ball (18, 53) in order to pull the gangway down toward the other end of the vessel (2) an the installation (20).

2. A conveyance system according to claim 1, characterized in that the frame (8, 32) comprises two legs (13, 14; 47) which are pivotably connected to the boom (7, 31) and extend from their respective sides of the boom (7, 31) and enclose the gangway (6, 33) on two sides, and that the legs (13, 14; 47) define an opening (16) therebetween, through which opening (16) a trolley (22, 84) that runs along the boom (7, 31) is capable of moving.

3. A conveyance system according to claim 2, characterized in that the ball (18, 53) and the ball seat (19, 45) are drawn toward each other with the aid of a positive downward tractive force, there being used a winch with constant tractive force to counter the downward tractive force.

4. A conveyance system according to claim 3, characterized in that the frame (8, 32) may be compelled to pivot relative to the boom (7, 31) by means of an actuator (21, 42).

5. A conveyance system according to claim 1, characterized in that the boom (31) is articulated.

6. A conveyance system according to claim 1, characterized in that the gangway (6, 33) is designed to be telescoped into contracted state by means of a trolley (22, 84) and that the trolley (22, 84) lays the gangway down onto the deck of the vessel (20).

7. A conveyance system according to claim 1, characterized in that it comprises a coupling means to hold the ball (53) in the ball seat (45).

8. A method of forming a walkable connection between a floating vessel (2) and an installation (20), wherein a boom (7, 31) which supports a gangway (6, 33) and the gangway which is connected to the one of the vessel (2) and the installation (20) which is swung into a position in which the one of a ball seat (19, 45) and a ball (18, 53) at the outer end of the gangway (6, 33) is generally over the other one of a ball seat (19, 45) and a ball (18, 53) on the other one of the vessel (2) and the installation (20), characterized in that a pull-down wire (27, 77) is connected between the ball (18, 53) and the ball seat (19, 45), the ball and/or ball seat having a through-going hole (28, 60) through which the pull-down wire is pulled such that the ball (18, 53) and the ball seat (19, 45) are drawn toward each other and that the ball (18, 53) is landed in the ball seat (19, 45).

9. A method according to claim 8, characterized in that a winch with constant tractive force is used to hold the boom (7, 31) hoisted above the other of the ball seat (19, 45) and the ball (18, 53) and that the winch is unloaded when the ball (19, 53) is landed in the ball seat (19, 45), such that the weight of the boom (7, 31) and the gangway (6, 33), holds the ball (18, 53) and the ball seat (19, 45) in engagement.

10. A motion absorbing conveyance system (1) for transferring personnel and/or objects between a floating vessel (2) and an installation (20) wherein the vessel (2) and the installation (20) exhibit a relative movement, which system (1) comprises a boom (7, 31), provided with an articulated connection to the one of the vessel (2) and the installation (20), and a variable length gangway (6, 33), having an articulated connection to the same one of the vessel (2) and the installation (20), and a connecting means (8, 32) which joins together the ends of the boom (7, 31) and the gangway (6, 33) opposite to the articulated connection, wherein one of the vessel (2) and the installation (29) has a means for securely coupling the gangway to the same one of the vessel (2) and the installation (20), characterized in that the means for coupling the gangway securely to one of the vessel (2) and the installation (20) comprises a ball seat (19, 45) and a ball (18, 53), one of the ball seat (19, 45) and the ball (18, 53) being arranged at the lower end of the connecting means (8, 32) and the other of the ball seat (19, 45) and the ball (18, 53) being arranged on one of the vessel (2) and the installation (20), the ball (18, 53) being arranged to engage with the ball seat (19, 45), such that the ball/seat connection accommodates triaxial relative movement between the vessel (2) and the installation (20), the ball (18, 53) and/or the ball seat (19, 45) comprising a through-going hole (28, 60) for a pull-down wire (27, 77), which is connectable to the other of the ball seat (19, 45) and the ball (18, 53) in order to pull the gangway down toward the other end of the vessel (2) and the installation (20), and that the connecting means is a frame, the frame being articulated coupled to the boom.

11. A motion absorbing conveyance system (1) for transferring personnel and/or objects between a floating vessel (2) and an installation (20), wherein the vessel (2) and the installation (20) exhibit a relative movement, which system (1) comprises a boom (7, 31), provided with an articulated connection to the one of the vessel (2) and the installation (20), and a variable length gangway (6, 33), having an articulated connection to the same one of the vessel (2) and the installation (20), and a connecting means (8, 32) which joins together the ends of the boom (7, 31) and the gangway (6, 33) opposite to the articulated connection, wherein one of the vessel (2) and the installation (29) has a means for securely coupling the gangway to the same one of the vessel (2) and the installation (20), characterized in that the means for coupling the gangway securely to one of the vessel (2) and the installation (20) comprises a ball seat (19, 45) and a ball (18, 53), one of the ball seat (19, 45) and the ball (18, 53) being arranged at the outer end of the gangway (6, 33) or at the lower end of the connecting means (8, 32) and the other of the ball seat (19, 45) and the ball (18, 53) being arranged on one of the vessel (2) and the installation (29), the ball (18, 53) being arranged to engage with the ball seat (19, 45) such that the ball/seat connection accommodates triaxial relative movement between the vessel (2) and the installation (20), the ball (18, 53) and/or the ball seat (19, 45) comprising a through-going hole (28, 60) for a pull-down wire (27, 77), which is connectable to the other of the ball seat (19, 45) and the ball (18, 53) in order to pull the gangway down toward the other end of the vessel (2) and the installation (20), that the connecting means is a frame, and that the boom has a trolley moveable along the length of the boom.

12. A method of forming a walkable connection between a floating vessel (2) and an installation (20), wherein a boom (7, 31) which supports a gangway (6, 33) and which is connected to the one of the vessel (2) and the installation (20) is swung into a position in which the one of a ball seat (19, 45) and a ball (18, 53) at the outer end of the gangway (6, 33) is generally over the other one of a ball seat (19, 45) and a ball (18, 53) on the other one of the vessel (2) and the installation (20), characterized in that a pull-down wire (27, 77) is connected between the ball (18, 53) and the ball seat (19, 45), the ball and/or ball seat having a through-going hole (28, 60) through which the pull-down wire is pulled such that the ball (18, 53) and the ball seat (19, 45) are drawn toward each other and that the ball (18, 53) is landed in the ball seat (19, 45), that the gangway is telescopic and a trolley being moveable along the length of the boom is suspending the outer end of the gangway (6, 33) until it is extracted and landed on the vessel (2) or the installation (20).

13. A method according to claim 12, characterized in that a frame (8, 32) is connected to the outer end of the boom (7, 31) and wherein one of the ball seat (19, 45) and the ball (18, 53), is coupled to the other of the ball seat (19, 45) and the ball (18, 53), and that the gangway (6, 33) is brought to a suspension in the frame (8, 32).

* * * * *